US011986102B2

(12) United States Patent
Moore

(10) Patent No.: US 11,986,102 B2
(45) **Date of Patent: *May 21, 2024**

(54) PORTABLE SUNSHADE

(71) Applicant: Bernadette Geselle Moore, Melbourne, FL (US)

(72) Inventor: Bernadette Geselle Moore, Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/219,960

(22) Filed: Jul. 10, 2023

(65) Prior Publication Data

US 2023/0346129 A1 Nov. 2, 2023

Related U.S. Application Data

(63) Continuation of application No. 17/695,938, filed on Mar. 16, 2022, now Pat. No. 11,700,945.

(60) Provisional application No. 63/163,081, filed on Mar. 19, 2021.

(51) Int. Cl.
*A47C 7/66* (2006.01)
*A47C 1/14* (2006.01)

(52) U.S. Cl.
CPC ..... *A47C 7/664* (2018.08); *A47C 1/14* (2013.01)

(58) Field of Classification Search
CPC ..... A47C 7/66
USPC ..... 297/184.11, 184.15
See application file for complete search history.

(56) References Cited

U.S. PATENT DOCUMENTS

| | | | | |
|---|---|---|---|---|
| 7,243,990 | B1 * | 7/2007 | Wahl | A47C 7/66 297/184.15 |
| 7,431,389 | B2 * | 10/2008 | Reeb | A47C 1/0265 297/184.11 X |
| 7,753,063 | B1 * | 7/2010 | Laws | A47C 7/66 |
| 9,451,830 | B1 * | 9/2016 | Buzzella | A47C 7/66 |
| 9,683,387 | B2 * | 6/2017 | Lovley, II | E04H 15/50 |
| 9,936,811 | B2 * | 4/2018 | Rowe, Jr. | E04H 15/02 |
| 10,791,843 | B2 * | 10/2020 | Rowe, Jr. | A47C 7/66 |
| 11,700,945 | B2 * | 7/2023 | Moore | A47C 7/664 297/184.16 |

(Continued)

*Primary Examiner* — Rodney B White
(74) *Attorney, Agent, or Firm* — DP IP GROUP; Franco S. De Liguori

(57) ABSTRACT

A portable sunshade configured for removable connection to a chair backrest has first, second and third sections removably connected to one another. The first section having a pair of first frame tubes, a pair of first cross tubes, a pair of second cross tubes, and joint connecting the first and second pairs of cross tubes to the frame. The second section is removably mounted to one end of the first section and has a pair of second frame tubes, a first fabric panel supported by the second frame tubes, and a pair of first hinge mechanisms connecting end portions of the second frame tubes to respective first end portions of the first frame tubes of the first section so as to permit the second section to undergo pivotal movement relative to the first section. The third section is removable mounted to another end of the first section opposite the one end thereof and has a pair of third frame tubes, a second fabric panel supported by the third frame tubes, and a pair of second hinge mechanisms connecting end portions of the third frame tubes to respective second end portions of the first frame tubes of the first section so as to permit the third section to undergo pivotal movement relative to the first section.

16 Claims, 44 Drawing Sheets

(56) References Cited

U.S. PATENT DOCUMENTS

| | | | | |
|---|---|---|---|---|
| 2009/0140556 | A1* | 6/2009 | Degelman | A47C 4/286<br>297/16.2 |
| 2023/0184001 | A1* | 6/2023 | Frankel | E04H 15/02<br>160/59 |

* cited by examiner

Section B-B

Section A-A

Section A-A

Section B-B

PORTABLE SUNSHADE

RELATED APPLICATION

This application claims priority of U.S. patent application Ser. No. 17/695,938, filed Mar. 16, 2022, now U.S. Pat. No. 11,700,945, issued Jul. 18, 2023, which claims the benefit of U.S. Provisional Patent Application No. 63/163,081, filed on Mar. 19, 2021.

BACKGROUND

Technical Field

The present invention relates to sunshades, and more particularly to a portable sunshade.

Background Information

Sunshades are often provided on lounge chairs. However, portable sunshades can be large, unwieldy, and heavy, which can make them difficult to set up and use. To overcome these problems, some sunshades are smaller and lighter in weight. However, to achieve a lightweight structure often sturdiness is sacrificed. Thus, these lightweight sunshades are easily damaged, especially when used at a beach where strong wind gusts are common. Moreover, the reduced size of the lightweight sunshades renders them ineffective for shielding an individual from sunlight.

SUMMARY

According to an aspect of the present invention, a portable sunshade is provided. In a first embodiment, the portable sunshade includes a backrest member configured to contact a backrest of a chair; a chair holding member coupled to an upper end of the backrest member; a sunshade member configured, when deployed, to extend horizontally with respect to the backrest member; and a connecting member. The connecting member includes opposing rails having crossbars spanning therebetween at an upper end and a lower end of the opposing rails. The opposing rails are rotationally affixed to the sunshade member at the upper end and rotationally affixed to the backrest member at the lower end. A ratchet mechanism is disposed at a midpoint of each of the crossbars, the ratchet mechanism being configured to allow folding of the crossbars.

According to another aspect of the present invention, a method of folding a portable sunshade according to the first embodiment is provided. The portable sunshade has a horizontally extending sunshade member, a backrest member and a connecting member therebetween with ratchet mechanisms disposed on crossbars. The method includes folding the sunshade member from a position perpendicular to the connecting member to a position parallel with and overlapping the connecting member; folding the backrest member to overlap the connecting member on a side opposite the sunshade member; and collapsing the crossbars by action of the ratchet mechanisms.

In another embodiment, a portable sunshade comprises first, second and third sections removably connected to one another. The first section has a pair of first frame tubes, a pair of first cross tubes, a pair of second cross tubes, and a plurality of joints connecting the first and second pairs of cross tubes to the frame tubes so that the frame tubes are disposed in generally parallel, spaced-apart relation to one another, and the first cross tubes are disposed in generally parallel, spaced-apart relation to the second cross tubes. The second section is removably mounted to one end of the first section and has second section having a pair of second frame tubes, a first fabric panel supported by the second frame tubes, and a pair of first hinge mechanisms connecting end portions of the second frame tubes to respective first end portions of the first frame tubes of the first section so as to permit the second section to undergo pivotal movement relative to the first section. The third section is removably mounted to another end of the first section opposite the one end thereof and has a pair of third frame tubes, a second fabric panel supported by the third frame tubes, and a pair of second hinge mechanisms connecting end portions of the third frame tubes to respective second end portions of the first frame tubes of the first section so as to permit the third section to undergo pivotal movement relative to the first section.

The first cross tubes contain a first elastic cord permitting the first cross tubes to be collapsed relative one another and relative to the first frame tubes. The second cross tubes contain a second elastic cord permitting the second cross tubes to be collapsed relative one another and relative to the first frame tubes. In an exemplary embodiment, the first and second elastic cords are bungee cords.

These and other features and advantages will become apparent from the following detailed description of illustrative embodiments thereof, which is to be read in connection with the accompanying drawings.

BRIEF DESCRIPTION OF DRAWINGS

The foregoing summary, as well as the following detailed description of preferred embodiments of the disclosure, will be better understood when read in conjunction with the accompanying drawings. For the purpose of illustrating the disclosure, there is shown in the drawings embodiments which are presently preferred. It should be understood, however, that the disclosure is not limited to the precise arrangement and instrumentalities shown.

The disclosure will provide details in the following description of preferred embodiments with reference to the following figures wherein.

DETAILED DESCRIPTION OF PREFERRED EMBODIMENTS

The present disclosure now will be described more fully hereinafter with reference to the accompanying drawings, in which exemplary embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art.

For convenience of description, the terms "front", "back", "upper", "lower", "top", "center", "bottom", "front", "rear", "right", "left", "side" and words of similar import will have reference to the various members and components of the exercise device of the present disclosure as arranged and illustrated in the figures of the drawings and described hereinafter in detail.

It should also be understood that the terms "about," "approximately," "generally," "substantially" and like terms, which may be used herein when referring to a dimension or characteristic of a component of the present disclosure, indicate that the described dimension/characteristic is not a strict boundary or parameter and does not exclude minor variations therefrom that are functionally the same or similar, as would be understood by one having ordinary skill in the art. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 1:
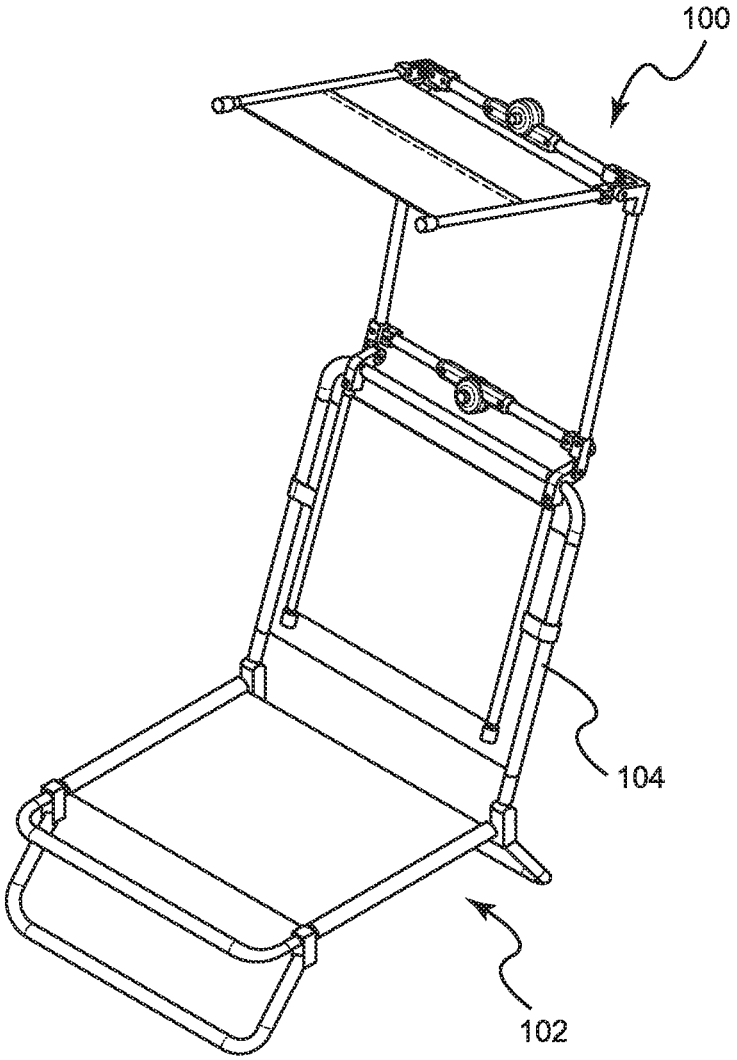
FIG. 1 is a representation of a portable sunshade, in accordance with an embodiment of the present invention, attached to a beach chair.

Many portable lounge chairs, such as beach chairs 102 shown in FIG. 1, are not equipped with sunshades. Consequently, individuals often must carry not only a beach chair 102, but also a bulky, heavy beach umbrella. Embodiments of the present invention provide a compact and light-weight portable sunshade 100 that can be mounted to a back rest 104 of a beach chair 102 as shown in FIG. 1.

Figure 2A:
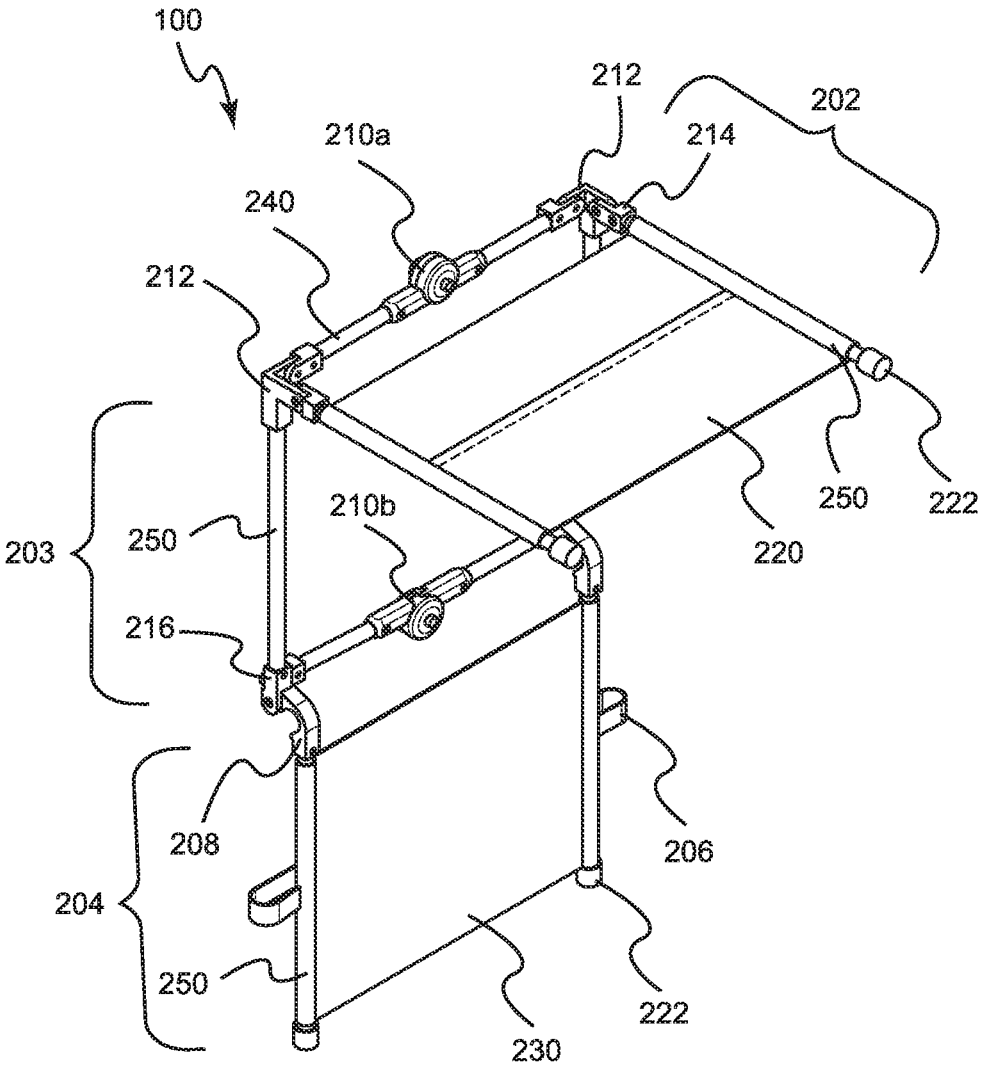
FIG. 2A is profile view of the portable sunshade shown in FIG. 1, in accordance with an embodiment of the present invention.
Figure 5:
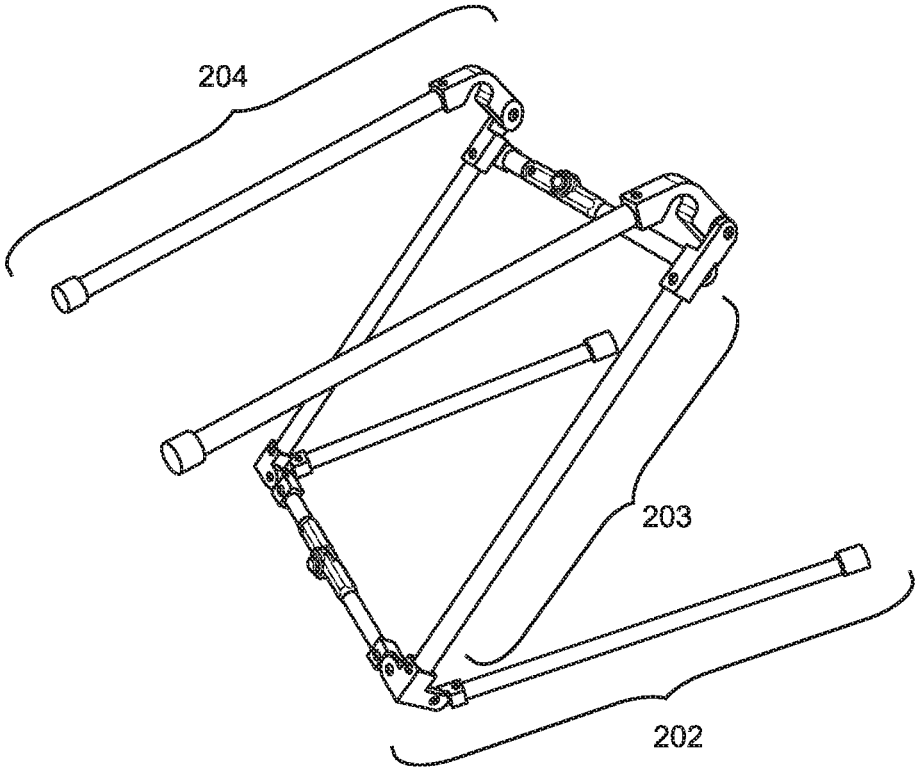
FIG. 5 shows a frame of a portable sunshade in a semi-collapsed state, in accordance with an embodiment of the present invention.
Figure 11A:
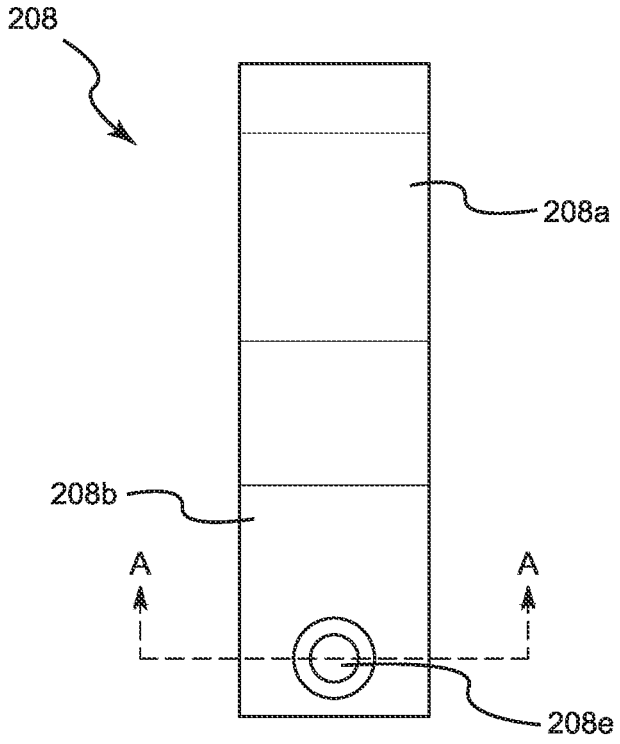
FIG. 11A is a rear view of a chair holding member, in accordance with an embodiment of the present invention.
Figure 11B:
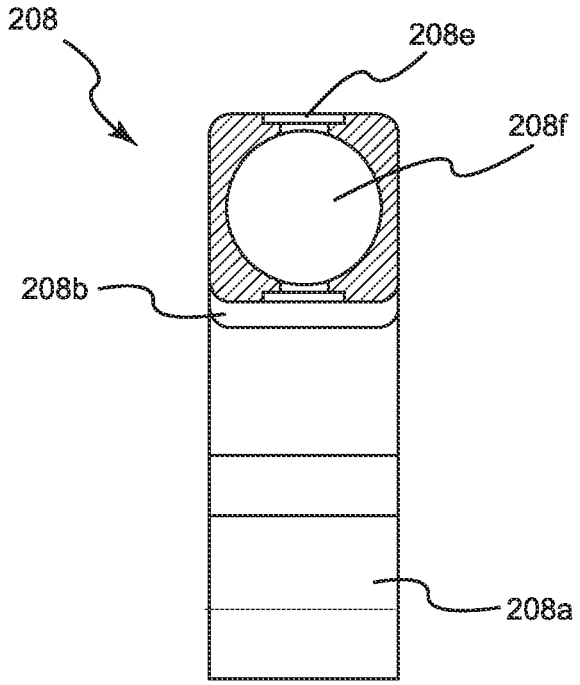
FIG. 11B is a partial cross-sectional view along line A-A of the chair holding member shown in FIG. 11A.
Figure 11C:
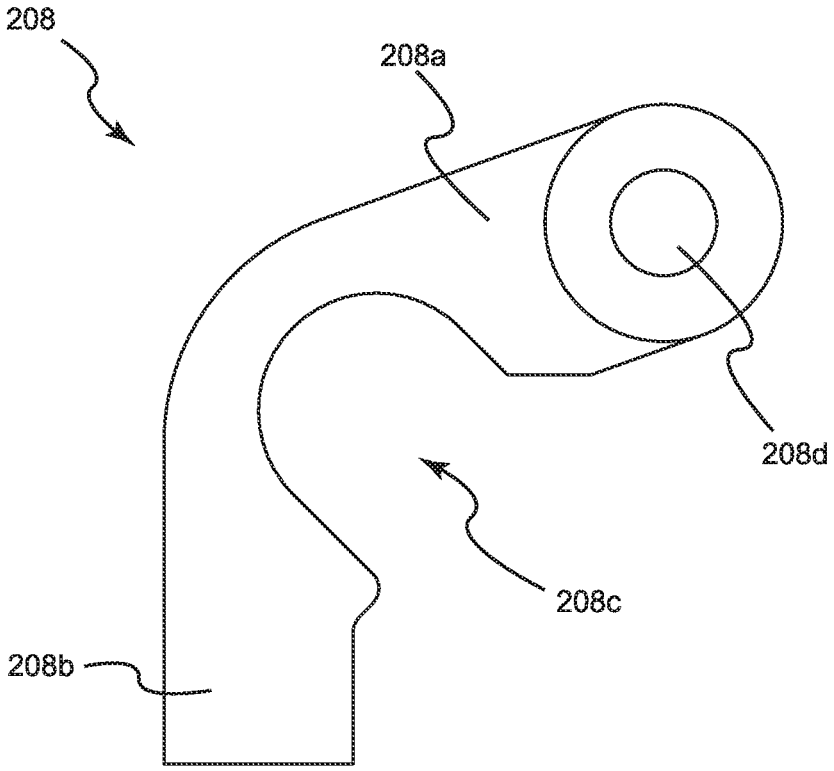
FIG. 11C is a side view of the chair holding member shown in FIG. 11A.

FIG. 2A shows a portable sunshade 100 embodiment of the present invention, and FIG. 1 shows the portable sunshade 100 attached to beach chair 102. The portable sunshade 100 includes a sunshade member 202 and a backrest member 204. The backrest member 204 is configured to rest against a backrest of beach chair 102. A flexible band 206 loops around the back of the backrest member 204 and is configured to hold the backrest member 204 against a backrest of beach chair 102. The sunshade member 202 is connected to the backrest member 204 by a connecting member 203. Additionally, the portable sunshade 100 includes chair holding members 208 configured to rest on a top rail of beach chair 102. Detailed views of the chair holding member 208 are shown in FIG. 11A, FIG. 11B and FIG. 11C. Upper ratchet mechanism 210*a* and lower ratchet mechanism 210*b* allow the portable sunshade 100 to fold into a compact form factor for portability as shown in FIG. 2E and FIG. 2F. This foldability/portability feature is also illustrated in FIG. 5 which shows a frame (without sunscreen fabric 220 and backrest fabric 230 as further described below) of the portable sunshade 100 in a semi-folded state.

As shown in FIGS. 2E and 2F, the portable sunshade 100 can be folded into a compact form factor by folding the sunshade member 202, from a position perpendicular to the connecting member 203 to a position parallel with and overlapping the connecting member 203; folding the backrest member 204 to overlap the connecting member 203 on a side opposite the sunshade member 202; and collapsing the folded portable sunshade 100 by action of the upper ratchet mechanism 210*a* and lower ratchet mechanism 210*b*.

Figure 2B:
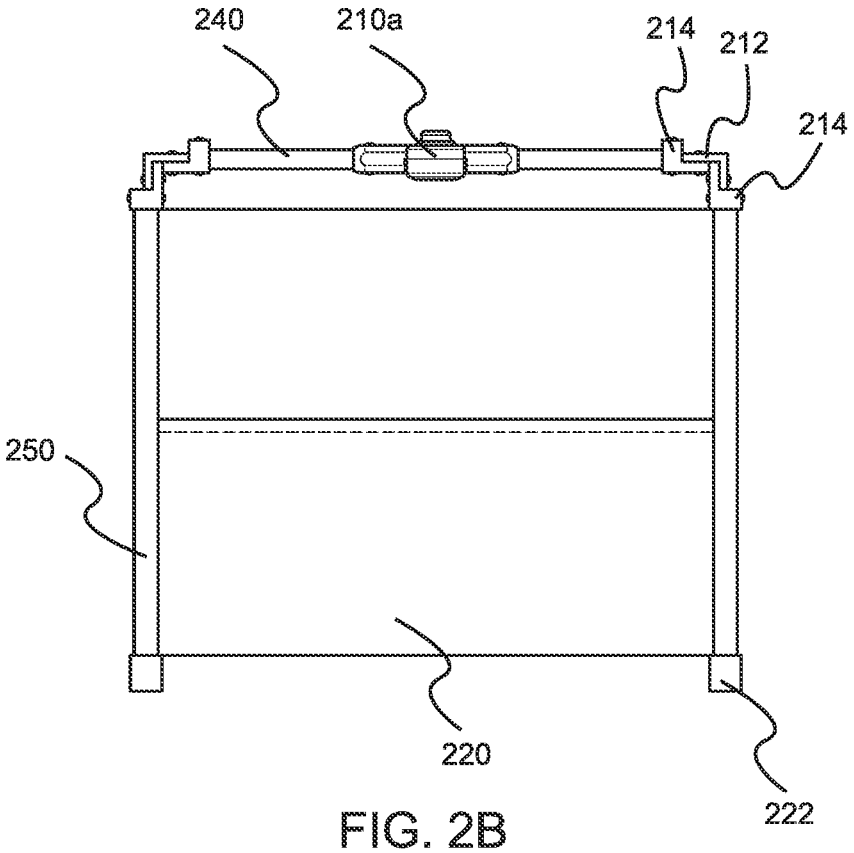
FIG. 2B is a top view of the portable sunshade shown in FIG. 2A.

FIG. 2B shows a top-down view of an embodiment of the portable sunshade 100. The sunshade member 202 includes a sunscreen fabric 220 stretched across two horizontally extending long rail members 250. The long rail members 250 can be terminated with caps 222 on the outward facing ends. Since the long rail members 250 can be hollow to reduce weight, the caps 222 can provide a seal against sand and water at the open end of the long rail members 250. Sunscreen fabric 220 is formed of two overlapping pieces of material that creates an air vent, minimizing the risk of the portable sunshade 100 flipping over in strong winds.

Figure 13:
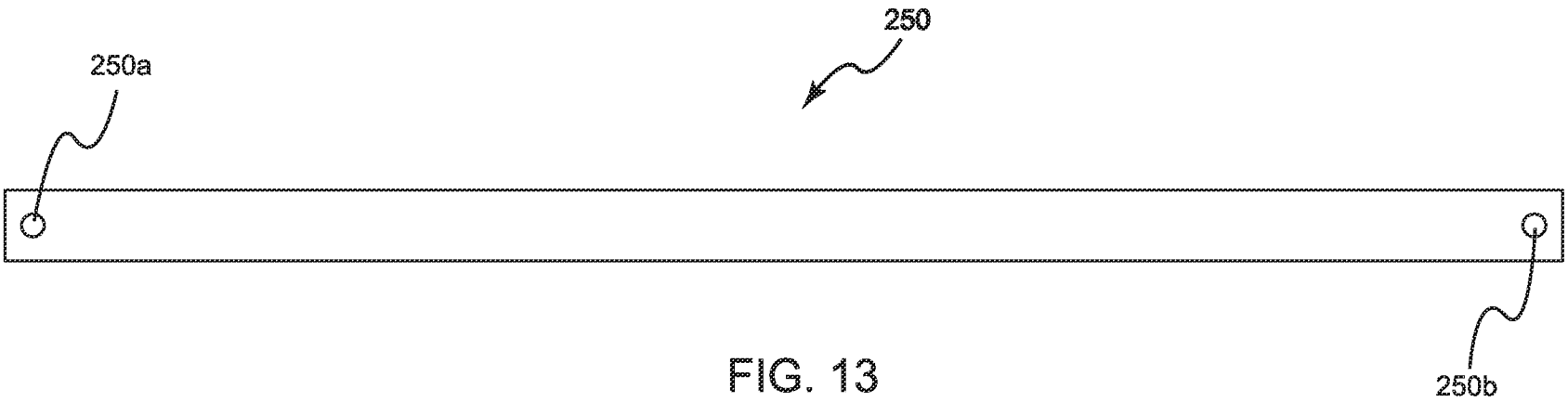
FIG. 13 is a side view of a long rail member, in accordance with an embodiment of the present invention.

FIG. 13 illustrates the long rail member 250 in greater detail. As shown in FIG. 13, the cross member 240 includes through holes 250*a* and 250*b* at both ends of the rail. The through holes 250*a* and 250*b* are configured to receive securing means 280 (shown in FIG. 6B, for example). The long rail member 250 has a length of between 12 inches and 24 inches. In a preferred embodiment the length of long rail member 250 is about 16 inches.

The sunscreen fabric 220 can be manufactured from any commonly known textile, such as nylon, polyester, rayon, cotton, or a combination of materials. Desirably, the sunscreen fabric 220 can block light penetration therethrough. However, in some embodiments the sunscreen fabric 220 is configured to block a portion of sunlight incident to the sunscreen fabric 220. In other embodiments, the sunscreen fabric 220 is selected for an ability to block certain wavelengths of sunlight, for example ultraviolet wavelengths, which are of most concern.

Figure 2C:
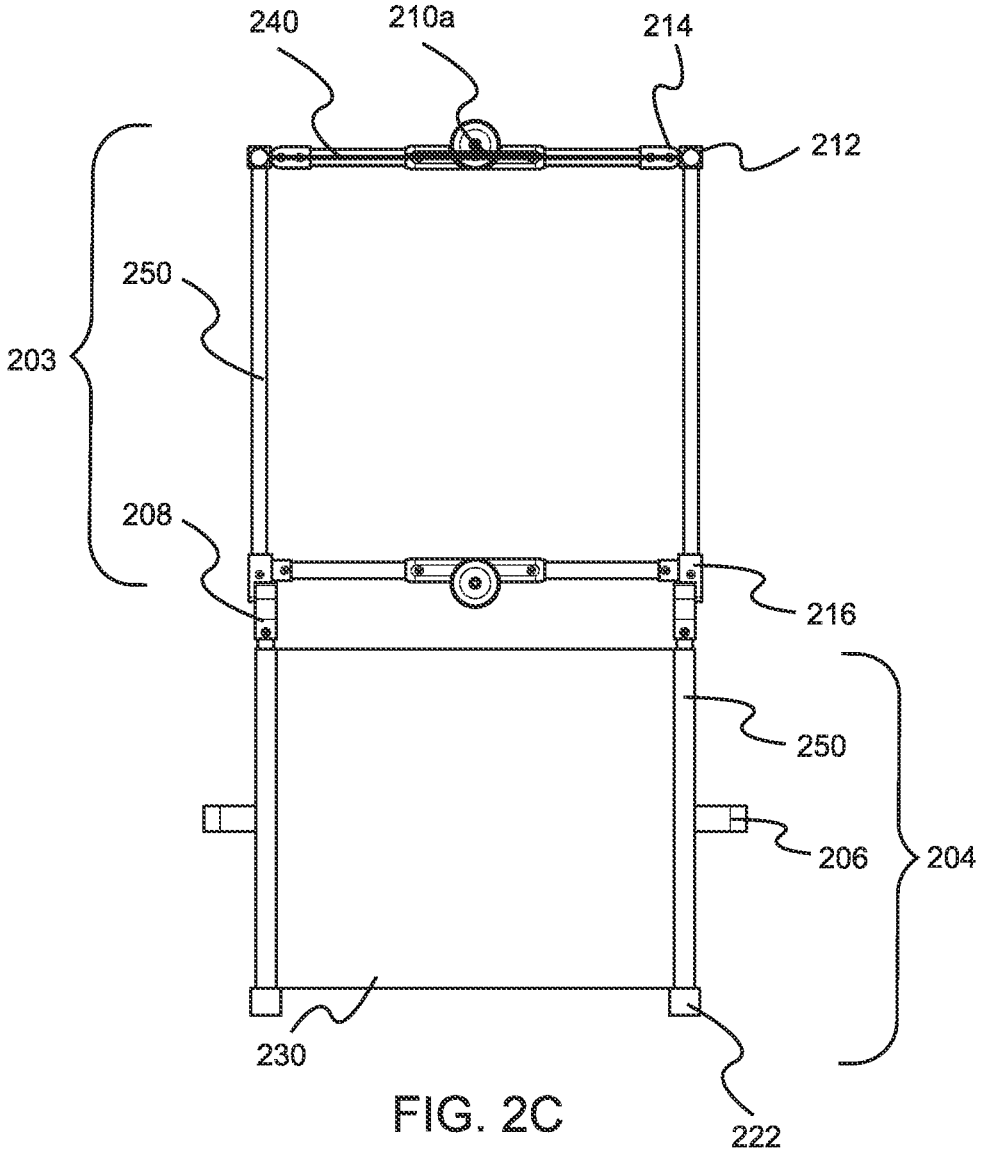
FIG. 2C is a front view of the center and bottom sections of the portable sunshade shown in FIG. 2A.

FIG. 2C illustrates a frontal view of an embodiment of the portable sunshade 100. The backrest portion 204 of the present embodiment includes a backrest fabric 230 held between two vertically disposed long rail members 250. The backrest fabric 230 can be manufactured from any commonly known textile, such as nylon, polyester, rayon, cotton, or a combination of materials. Additionally, the backrest fabric 230 can be made from the same material as the sunscreen fabric 220. In other embodiments, the backrest fabric 230 can be made from a material different than the sunscreen fabric 220 material.

Figure 2D:
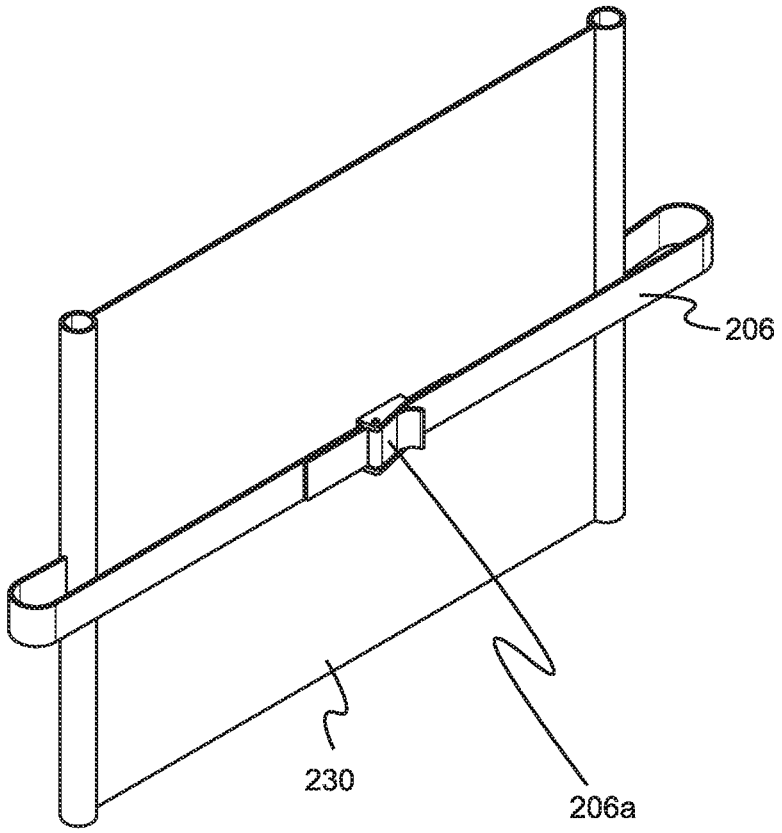
FIG. 2D is a rear view of a backrest portion of the portable sunshade shown in FIG. 2A.
Figure 2E:
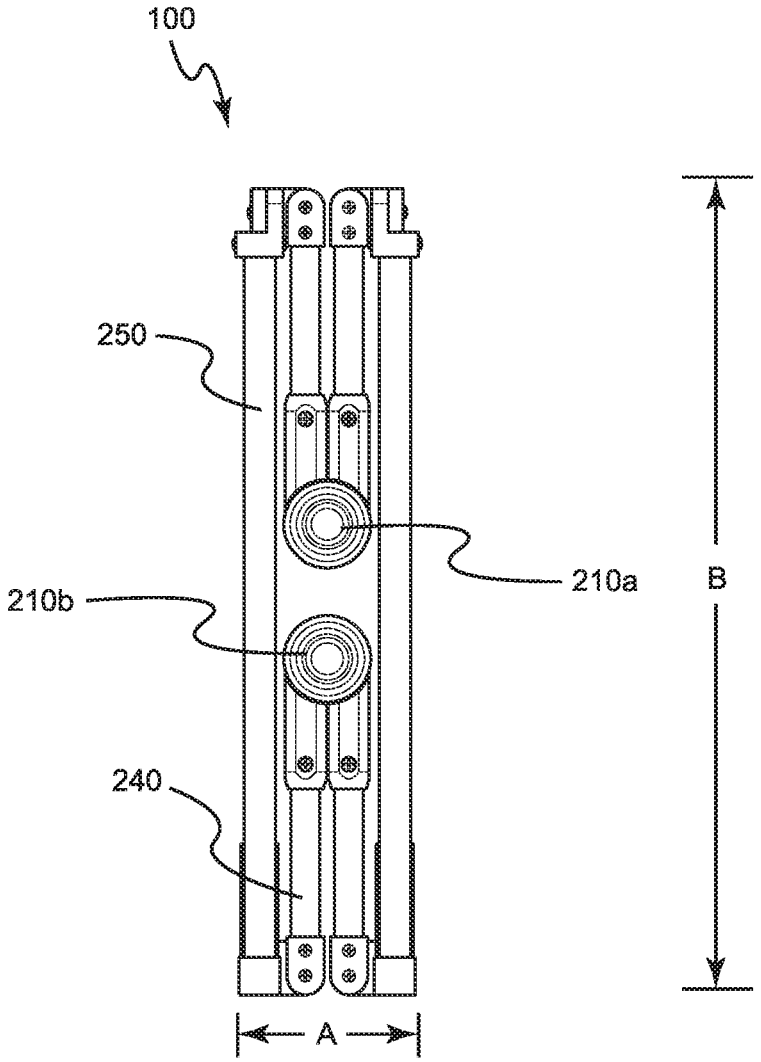
FIG. 2E is a front view of the portable sunshade shown in FIG. 2A in a folded configuration.
Figure 2F:
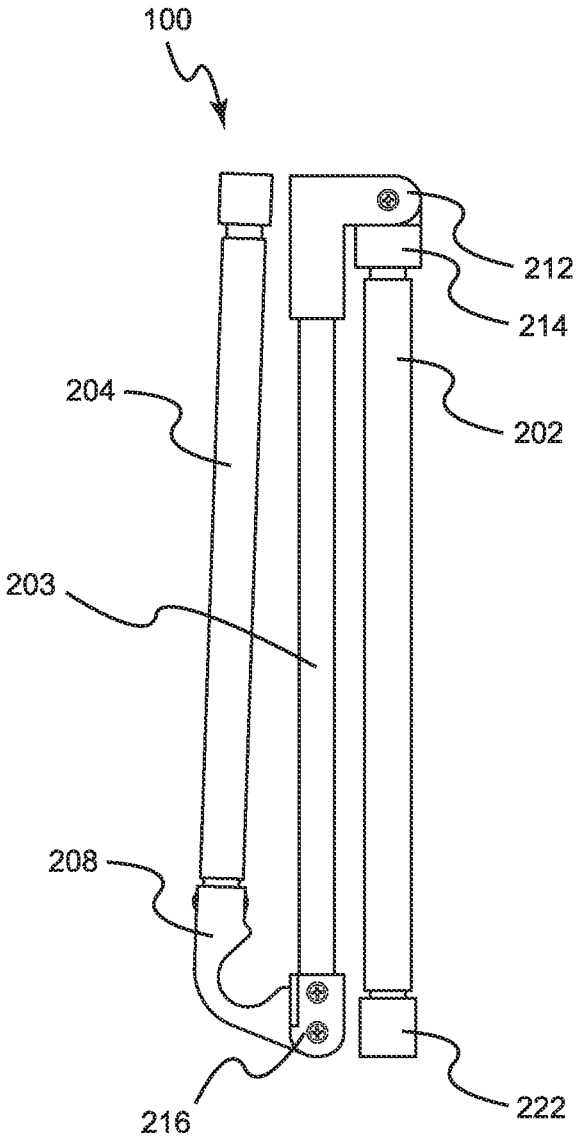
FIG. 2F is a profile view of the folded portable sunshade shown in FIG. 2E.

FIG. 2D illustrates a reverse side of the backrest fabric 230. As shown, the backrest fabric 230 includes a flexible band 206. The flexible band 206 can be formed as a single band of fabric, such as nylon, for example. In other embodiments, the flexible band 206 is constructed as two flexible bands 206, each attached at one end to opposite sides of the backrest fabric 230, and includes a buckle 206*a*, or other securing means, adjustably joining the free ends of the backrest fabric 230.

FIG. 2E shows a frontal view of an embodiment of the portable sunshade 100 in which the upper ratchet mechanism 210*a* and the lower ratchet mechanism 210*b* are in the closed position and the portable sunshade 100 is a folded configuration. Herein the upper ratchet mechanism 210*a* and the lower ratchet mechanism 210*b* are collectively referenced as ratchet mechanism 210. In this configuration, the portable sunshade 100 can be easily transported and/or stored. FIG. 2F shows a side view of the portable sunshade 100 corresponding to the frontal view shown in FIG. 2E. In the folded configuration shown in FIG. 2E, the portable sunshade 100 has an overall width "A" in the range of about 2 inches to about 6 inches and an overall height "B" in the range of about 12 inches to 24 inches. In a preferred embodiment, the dimension "A" is about 3.5 inches and the dimension "B" is about 16 inches.

Figure 3:
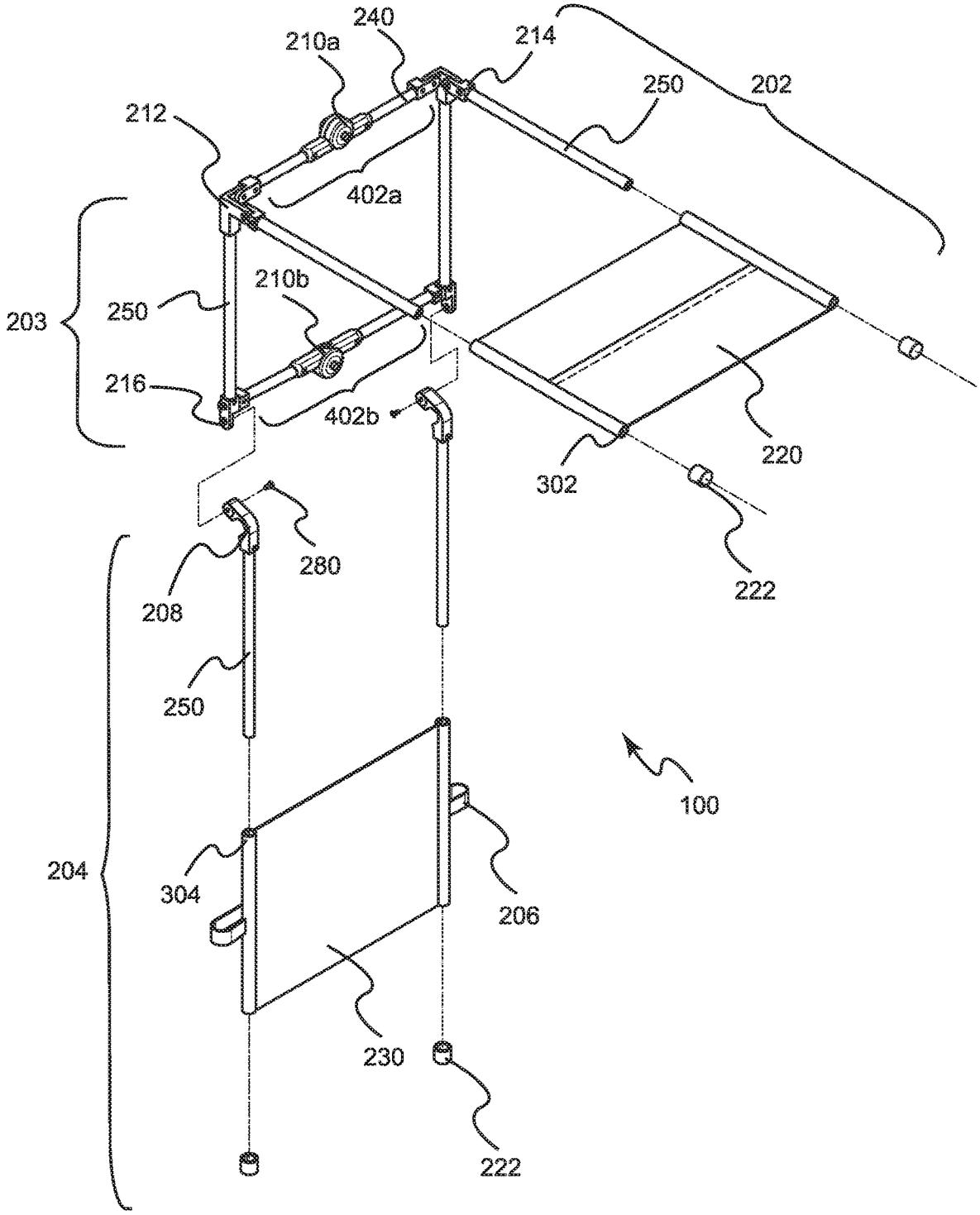
FIG. 3 is an exploded view of a portable sunshade, in accordance with an embodiment of the present invention.

Turning now to FIG. 3, an exploded view of an embodiment of the portable sunshade 100 is illustrated. The sunshade member 202 includes a sunscreen fabric 220 that is mated to two long rail members 250 by way of fabric loops 302 formed on the sunscreen fabric 220. End caps 222 are fitted to outward facing ends of the long rail members 250. The end caps 222 in some embodiments can be dimensioned to restrict removal of the sunscreen fabric 220. An inward facing end of each of the long rail members 250 of the sunshade member 202 has a first joint 214 fixed thereon.

Figure 6A:
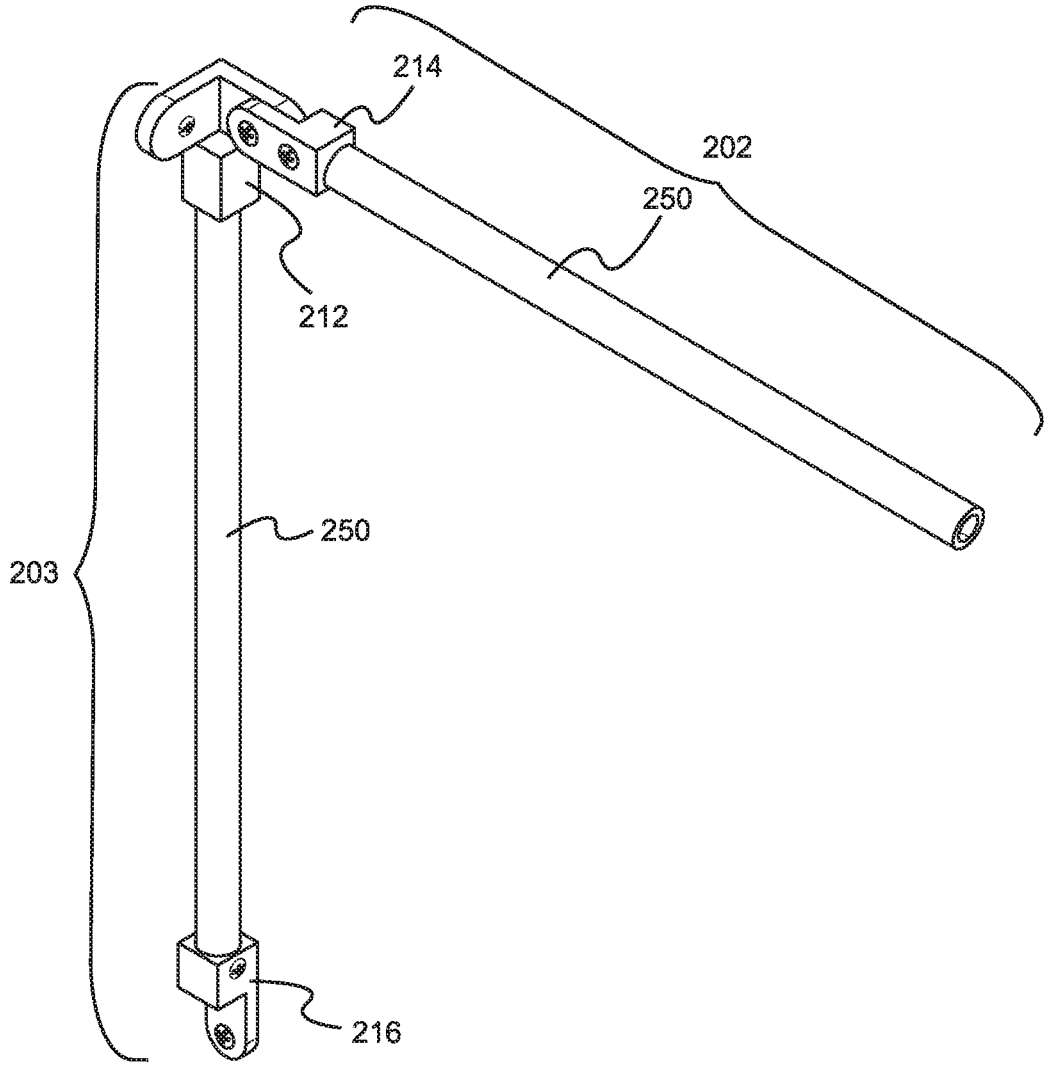
FIG. 6A shows a right vertical rail section, in accordance with an embodiment of the present invention.
Figure 6B:
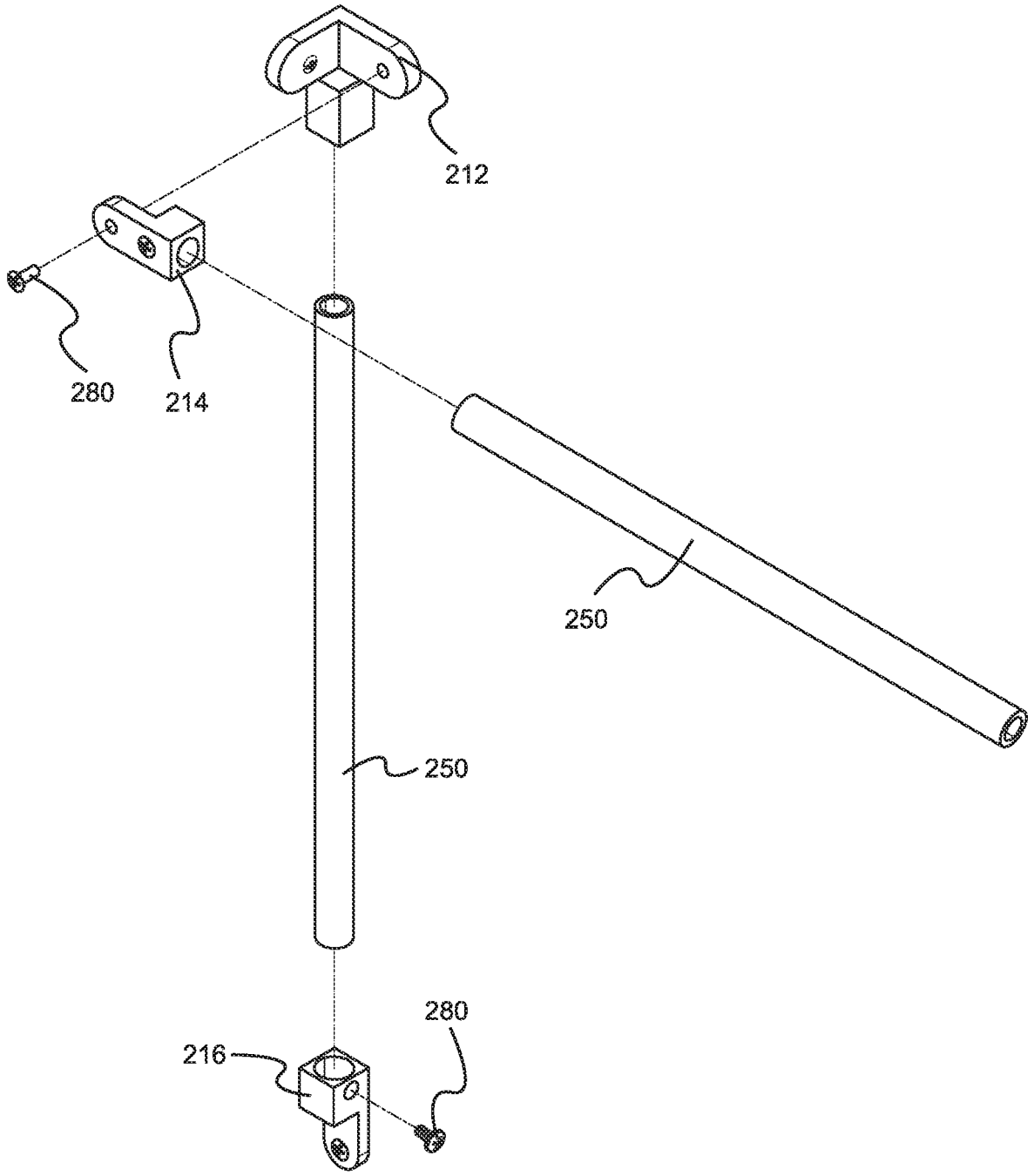
FIG. 6B is an exploded view of the vertical rail section shown in FIG. 6A.
Figure 8A:
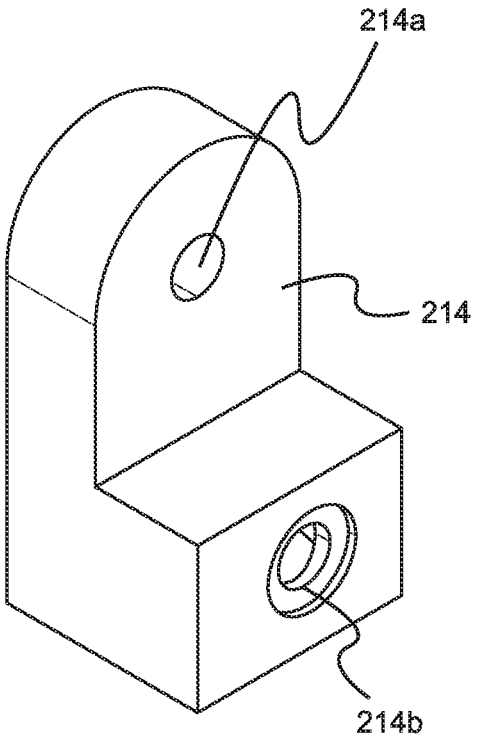
FIG. 8A is a profile view of a first joint, in accordance with an embodiment of the present invention.
Figure 8B:
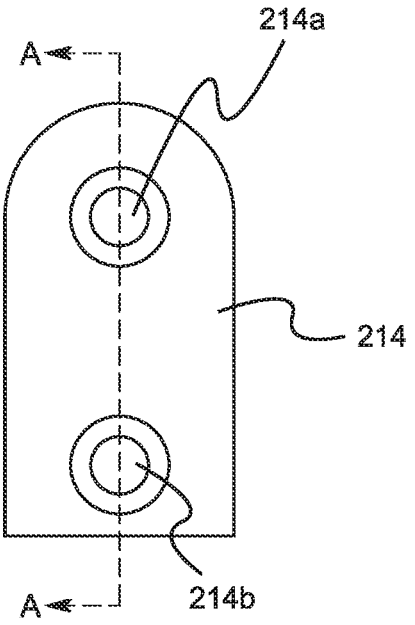
FIG. 8B is a rear view of the first joint shown in FIG. 8A.
Figure 8C:
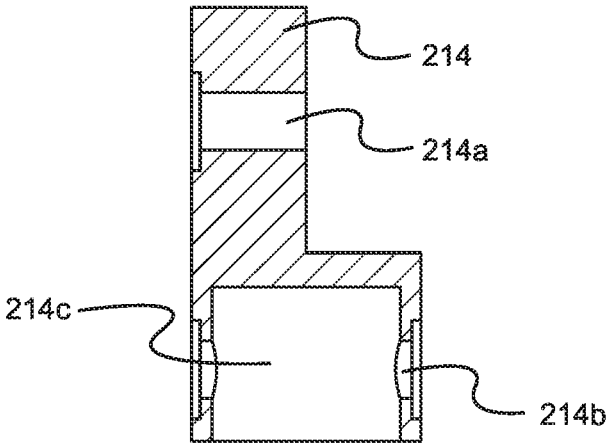
FIG. 8C is a cross-sectional view along line A-A of the first joint shown in FIG. 8A.
Figure 9A:
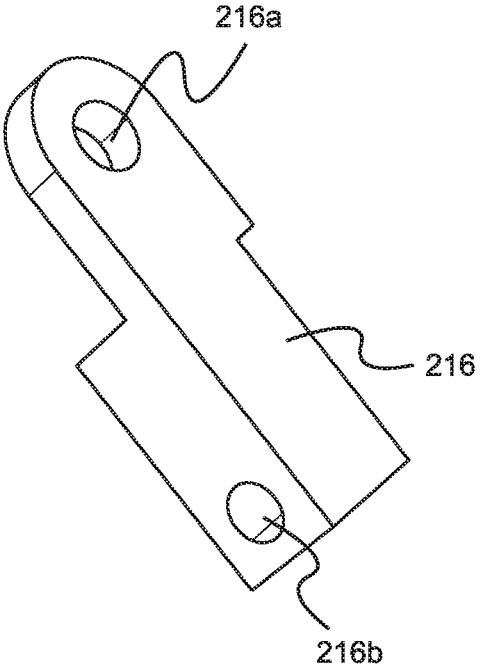
FIG. 9A is a profile view of a second joint, in accordance with an embodiment of the present invention.
Figure 9B:
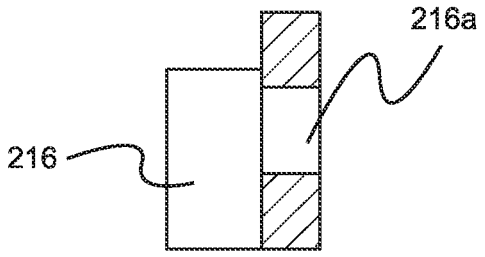
FIG. 9B is a cross-sectional view along line B-B of the second joint shown in FIG. 9D.
Figure 9C:
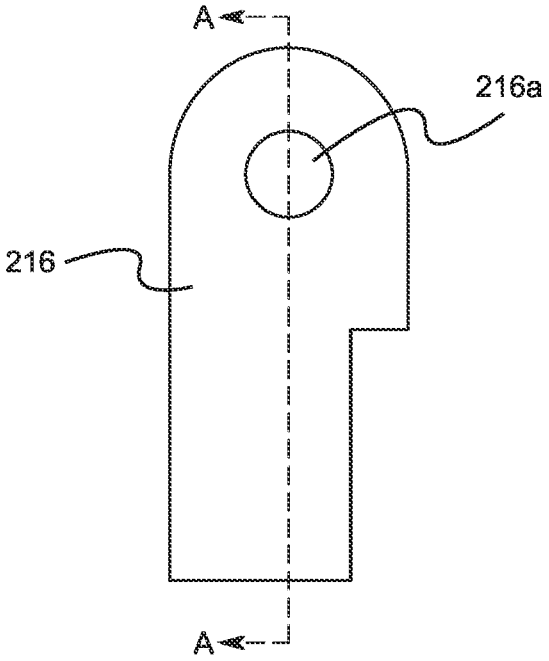
FIG. 9C is a side view of the second joint shown in FIG. 9A.
Figure 9D:
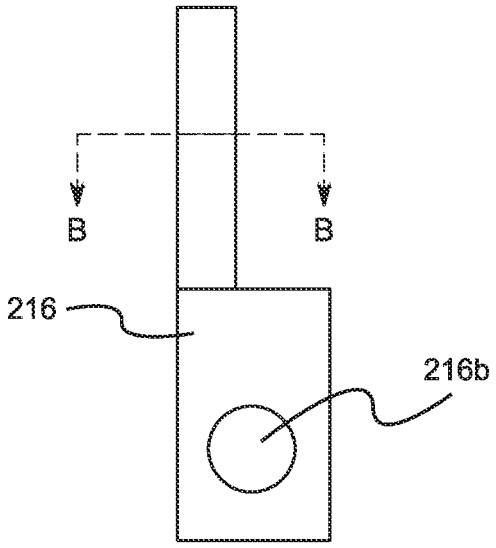
FIG. 9D is a front view of the second joint shown in FIG. 9A.
Figure 9E:
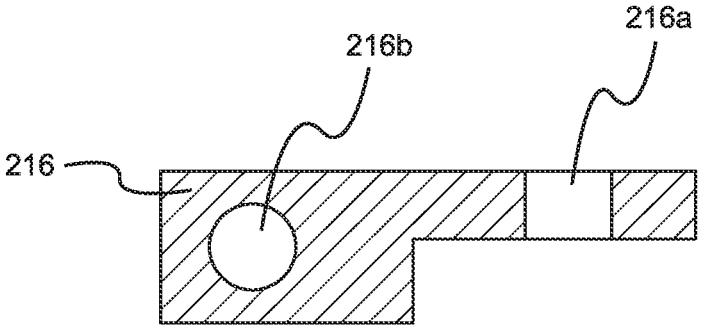
FIG. 9E is a cross-sectional view along line A-A of the second joint shown in FIG. 9C.
Figure 10A:
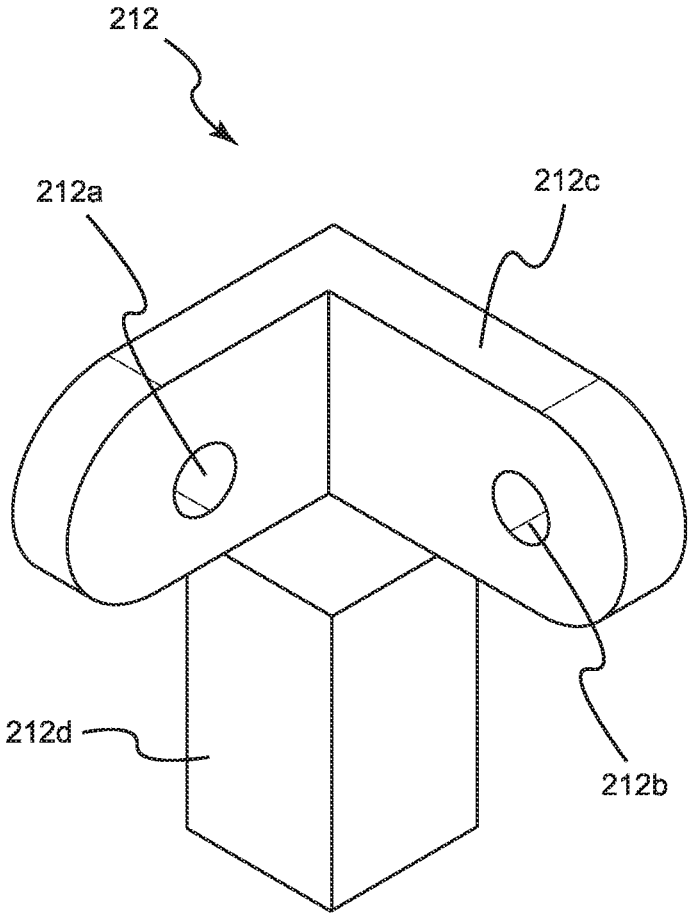
FIG. 10A is a profile view of a corner joint, in accordance with an embodiment of the present invention.
Figure 10B:
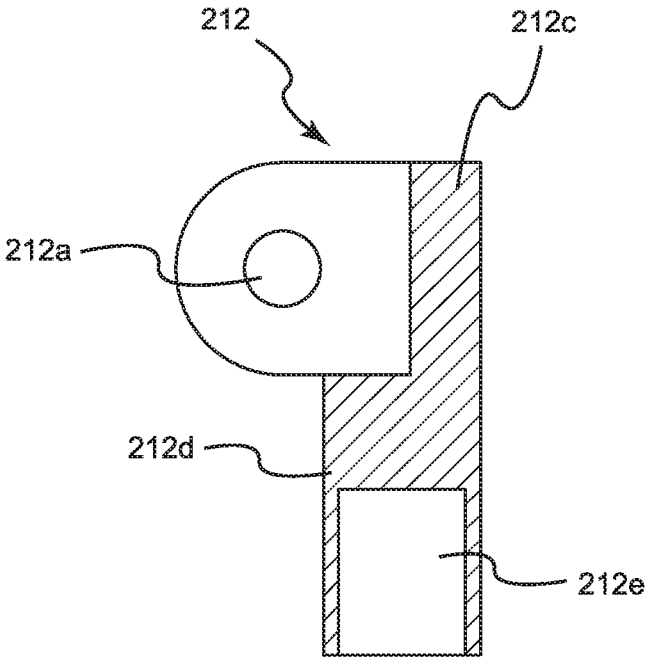
FIG. 10B is a cross-sectional view along line A-A of the corner joint shown in FIG. 10D.
Figure 10C:
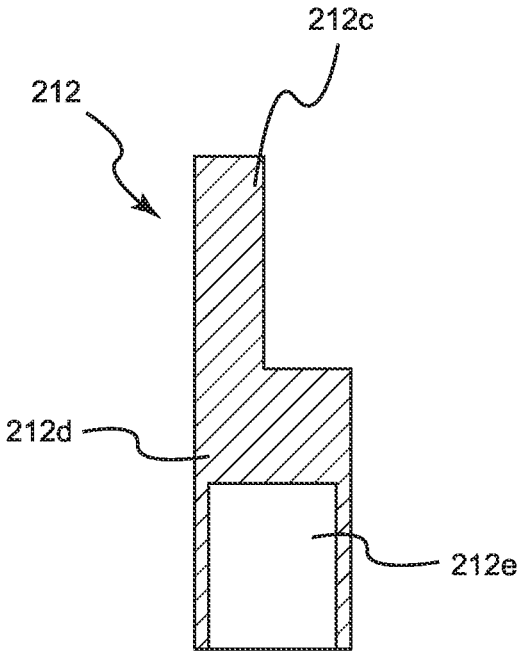
FIG. 10C is a cross-sectional view along line B-B of the corner joint shown in FIG. 10E.
Figure 10D:
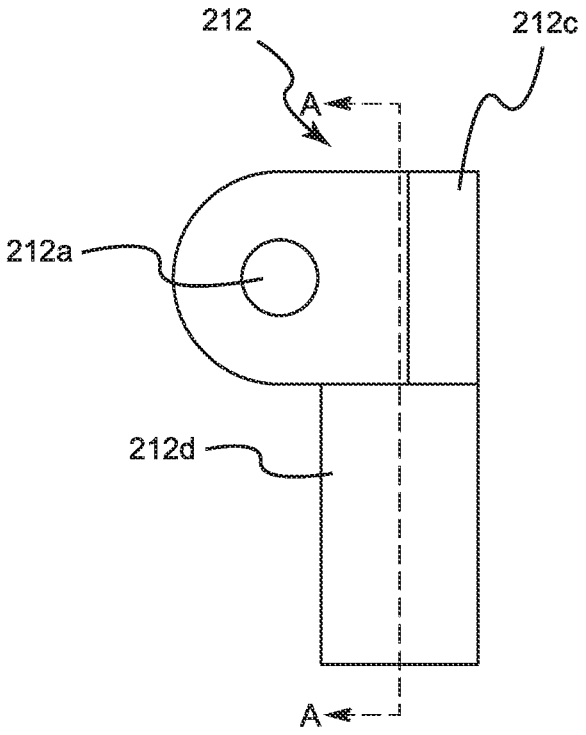
FIG. 10D is a side view of the corner joint shown in FIG. 10A.
Figure 10E:
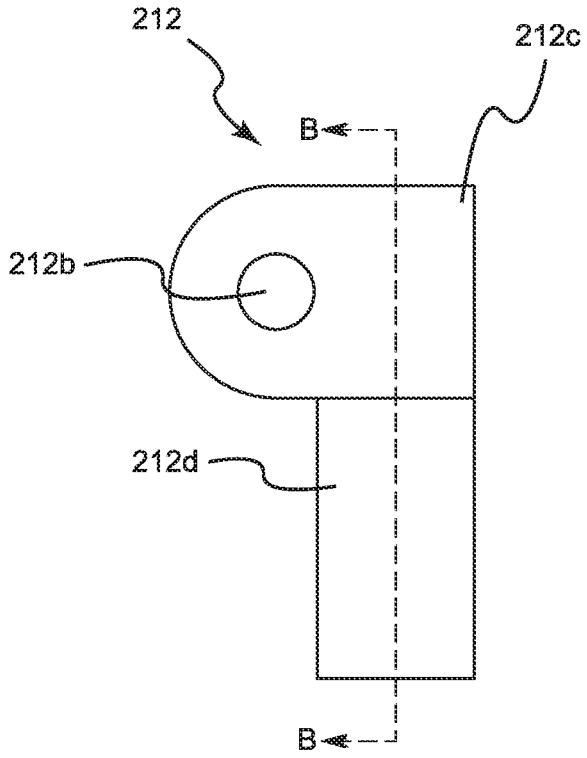
FIG. 10E is a front view of the corner joint shown in FIG. 10A.

FIG. 8A-8C show detailed views of the first joint 214. As shown in the cross-sectional view of the first joint in FIG. 8C taken along line A-A in FIG. 8B, the inward facing end of the long rail member 250 is inserted into a rail receiving cavity 214C and secured with securing means 280 (shown in FIG. 6B, for example), such as a screw, nut and bolt, push button snap clip, adhesive, and/or heat weld, for example. When using a screw, nut and bolt, or push-button snap clip, the first joint 214 includes a through hole 214*b* for receiving the screw, nut and bolt, or push-button snap clip. Additionally, a second through hole 214*a* is formed on the first joint 214 and configured to receive a securing means 280 such that the first joint is secured to a corner joint 212, shown in greater detail in FIG. 10A-10E. Specifically, the first joint 214 of each of the sunshade members 202 is attached to the corner bracket segment 212*c* (shown in FIG. 10A) of the corner joint 212 using a securing means 280, such as a screw or nut and bolt, for example, extending through the second through hole 214*a* and a second through hole 212*b* formed on the corner bracket segment 212*c*. FIGS. 6A and 6B show the construction of half of the sunshade member 202, namely a right half, in greater detail.

Figure 4A:
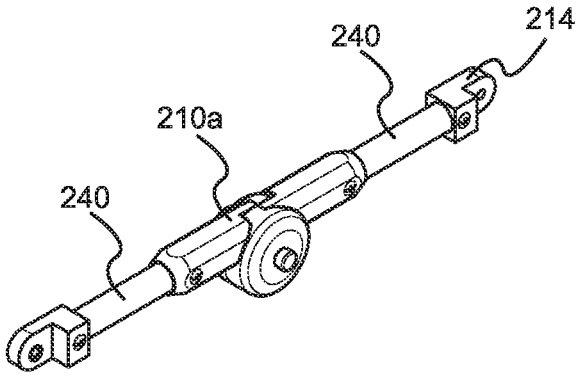
FIG. 4A shows a horizontal rail section, in accordance with an embodiment of the present invention.
Figure 4B:
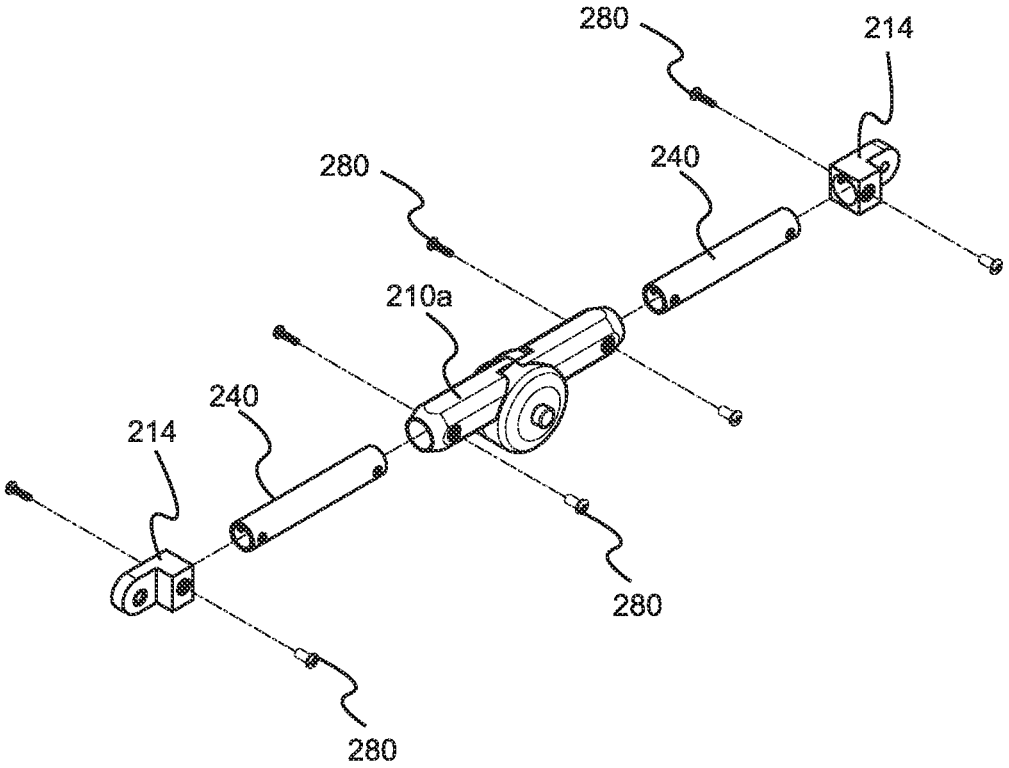
FIG. 4B is an exploded view of the horizontal rail shown in FIG. 4A.

The two long rail members 250 forming the sunshade member 202 are held together by a first crossbar 402*a* formed of a ratchet mechanism 210 coupled to cross members 240 on either side as shown in FIGS. 4A and 4B. The first crossbar 402*a* is also referred to herein as an upper crossbar 402*a*. The free ends of the cross members 240 are capped with first joints 214. The first crossbar 402*a* is attached to the corner joints using a screw, or nut and bolt passed through the through hole 214*a* of the first joint 214*a* and a first through hole 212*a* of the corner bracket 212*c* (shown in FIG. 10A).

Figure 12:
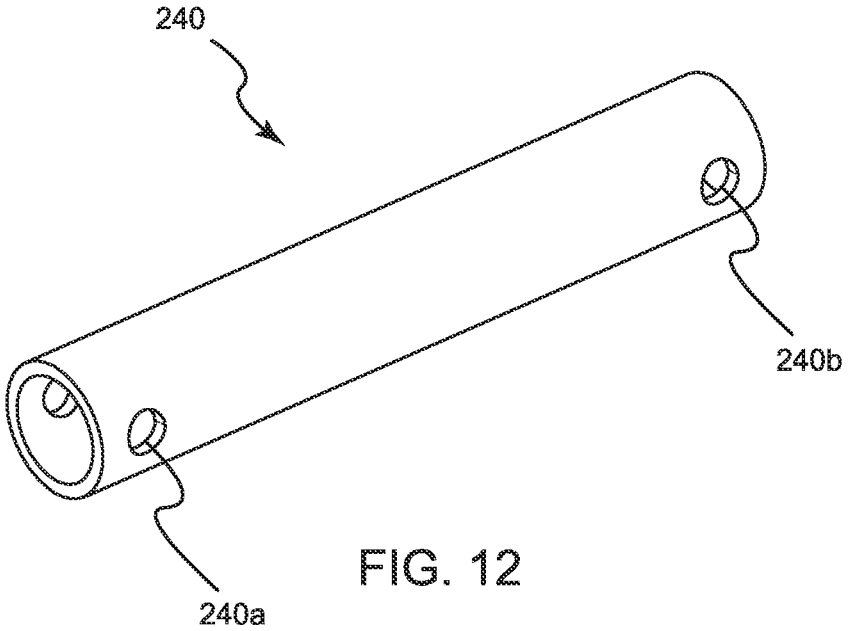
FIG. 12 is a profile view of a cross member, in accordance with an embodiment of the present invention.

FIG. 12 illustrates the cross member 240 in greater detail. As shown in FIG. 12, the cross member 240 includes through holes 240*a* and 240*b* at both ends of the rail. The through holes 240*a* and 240*b* are configured to receive securing means 280. The cross member 240 has a length of between about 6 inches and about 12 inches. In a preferred embodiment the length of the cross member 240 is about 7 inches.

A connecting member 203 includes a long rail member 250 affixed to the corner joint 212 by way of a receiving cavity 212*e* (shown in FIG. 10E) formed in a pillar 212*d* of the corner joint 212. The long rail member 250 can be secured to the corner joint 212 with a securing means 280, such as a screw, nut and bolt, push button snap clip, adhesive, and/or heat weld, for example. A second joint 216 is secured to the opposite end of the long rail member 250 as well. The second joint 216 is shown in greater detail in FIG. 9A-9E. The long rail member 250 is inserted into a receiving cavity (not shown) of the second joint 216 and secured by a securing means 280, such as a screw, nut and bolt, push button snap clip, adhesive, and/or heat weld, for example, by way of through hole 216*b*. The securing means 280 further affixes a second crossbar 402*b*, which includes a lower ratchet mechanism 210*b*, to the second joint 216 by passing the securing means 280 into through hole 216*b* and through hole 214*a*. The second crossbar 402*b*, is also referred to herein as a lower crossbar 402*b*. The upper crossbar 402*a* and the lower crossbar 402*b* are, herein, commonly and/or collectively referenced as "crossbar 402". The upper crossbar 402*a*, the lower crossbar 402*b* and the two long rail members 250, fabricated and joined as described above, form an upright section of the portable sunshade 100.

Figure 7A:
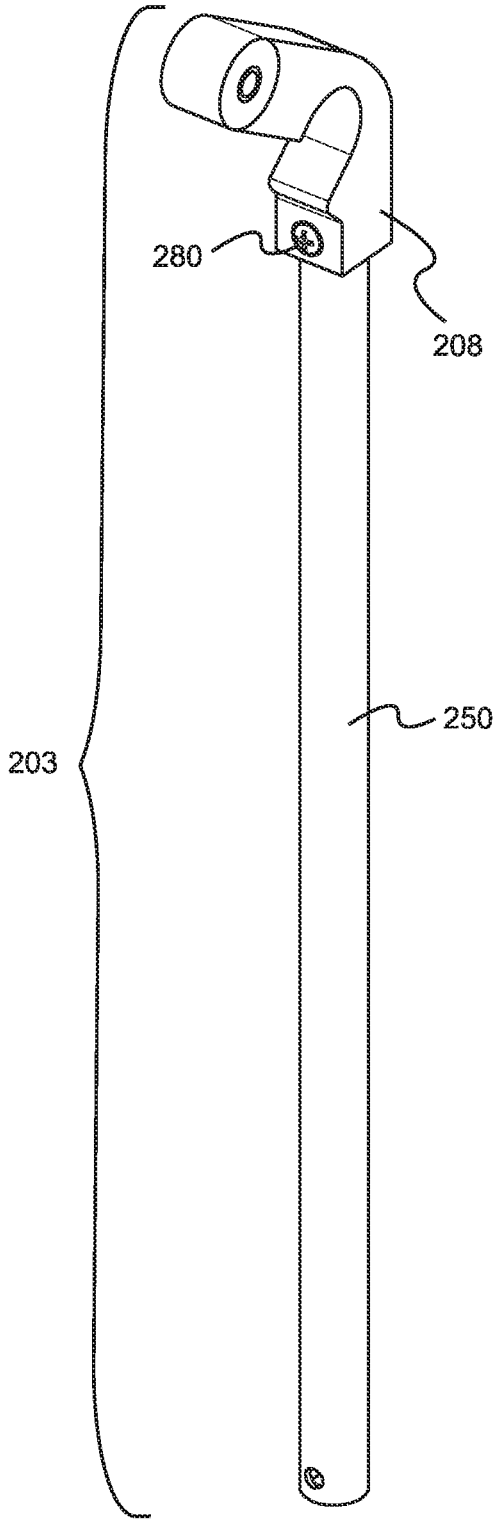
FIG. 7A shows a chair rail section, in accordance with an embodiment of the present invention.
Figure 7B:
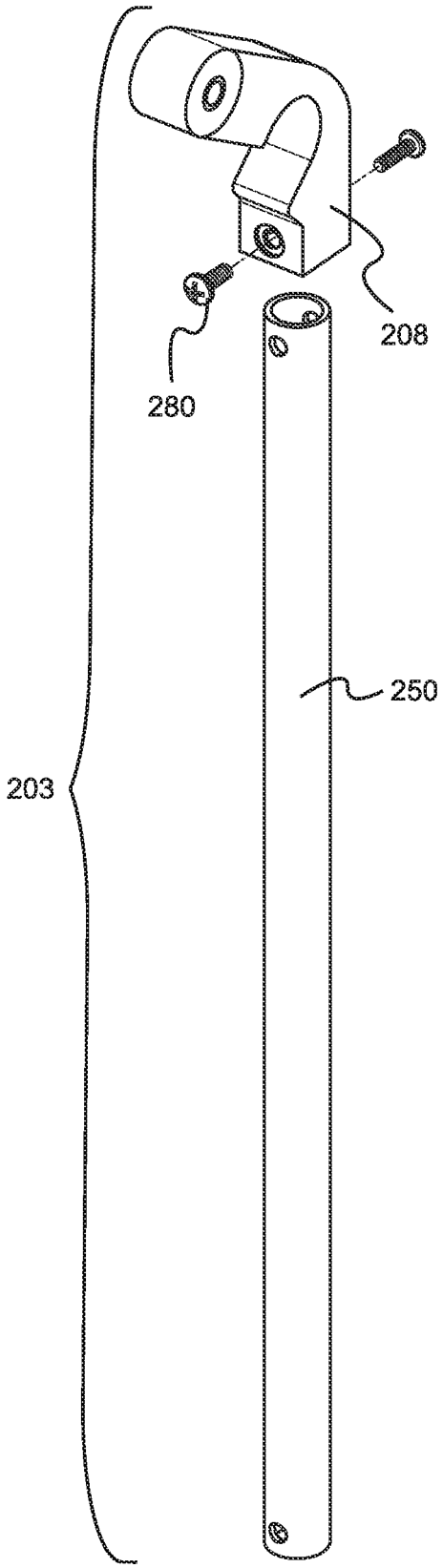
FIG. 7B is an exploded view of the chair rail section shown in FIG. 7A.

The backrest member 204 of the portable sunshade 100 can be constructed from two long rail members 250 having a chair holding member 208 joined to an end of each of the two long rail members 250. FIG. 7A shows a detailed view of a portion of the backrest member 204, and FIG. 7B illustrates an exploded view of the portion of the backrest member 204 shown in FIG. 7A. As shown in FIGS. 7A and 7B, the chair holding member 208 is secured to the long rail member 250 with a securing means 280, such as a screw, nut and bolt, push button snap clip, adhesive, and/or heat weld, for example.

FIG. 11A-11C show detailed views of the chair holding member 208. Specifically, turning to FIG. 11C, the chair holding member 208 has an upper arm 208*a* and a lower arm 208*b* configured to form an angle less than 90° therebetween. Additionally, the junction between the upper arm 208*a* and the lower arm 208*b* has a chair receiving notch 208*c* formed on inside of the chair holding member 208. The chair receiving notch 208*c* is dimensioned to receive a top rail of a chair back. In this way, the chair holding member 208 rests on and is held by the top rail of the chair when properly mounted.

Turning to FIG. 11B, the lower arm 208*b* includes a rail receiving cavity 208*f* formed on an underside of the chair holding member 208. A through hole 208*e* is formed on a side of the lower arm 208*b* and intersects the rail receiving cavity 208*f*. The through hole 208*e* can be configured to accept the securing means 280, thereby holding the long rail member 250 securely in place. The upper arm 208*a* includes a through hole 208*d* configured to accept a securing means 280 therein to couple the chair holding member 208 to the second joint 216 at through hole 216*a*.

The backrest member 204 further includes a backrest fabric 230 secured to the long rail members 250. Specifically, the long rail members 250 can be inserted into loops 304 formed along edges of the backrest fabric 230. The backrest fabric 230 can, in some embodiments, be secured to the long rail members 250 by rivets. The free ends of the long rail members 250 are sealed with end caps 222.

The portable sunshade 100 includes ratchet mechanisms that enable the portable sunshade to be folded in a compact form factor as described herein. For example, such ratchet mechanisms can be in the form of ratchet hinges and similar types of devices. Alternatively, any means for enabling the portable sunshade to be folded in a compact form factor is suitable without departing from the spirit and scope of the invention.

FIGS. 14-29 illustrate a second embodiment of the portable sunshade, generally designated at 400, according to the present invention.

As shown in FIGS. 14-17, portable sunshade 400 has a modular construction in that it is formed of the following three sections which can be readily and securely assembled together to form portable sunshade 400: a top section 420; a center section 440; and a bottom section 460. The components and construction of sections 420, 440 and 460 are described in further detail below with reference to FIGS. 20-22, 23-25, and 26-29, respectively.

Figure 14:
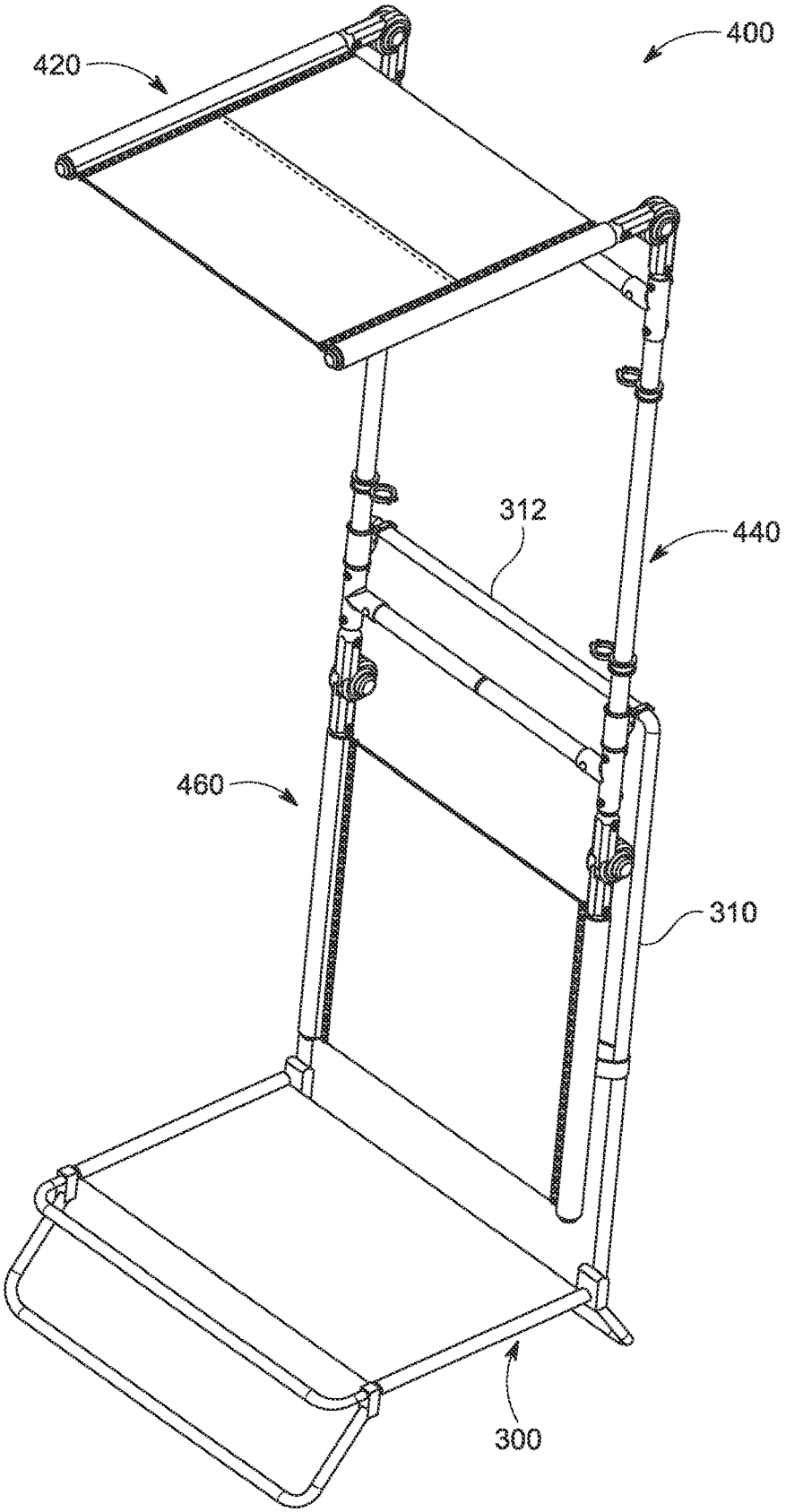
FIG. 14 is a representation of a portable sunshade, in accordance with a second embodiment of the present invention, attached to a beach chair.
Figure 15:
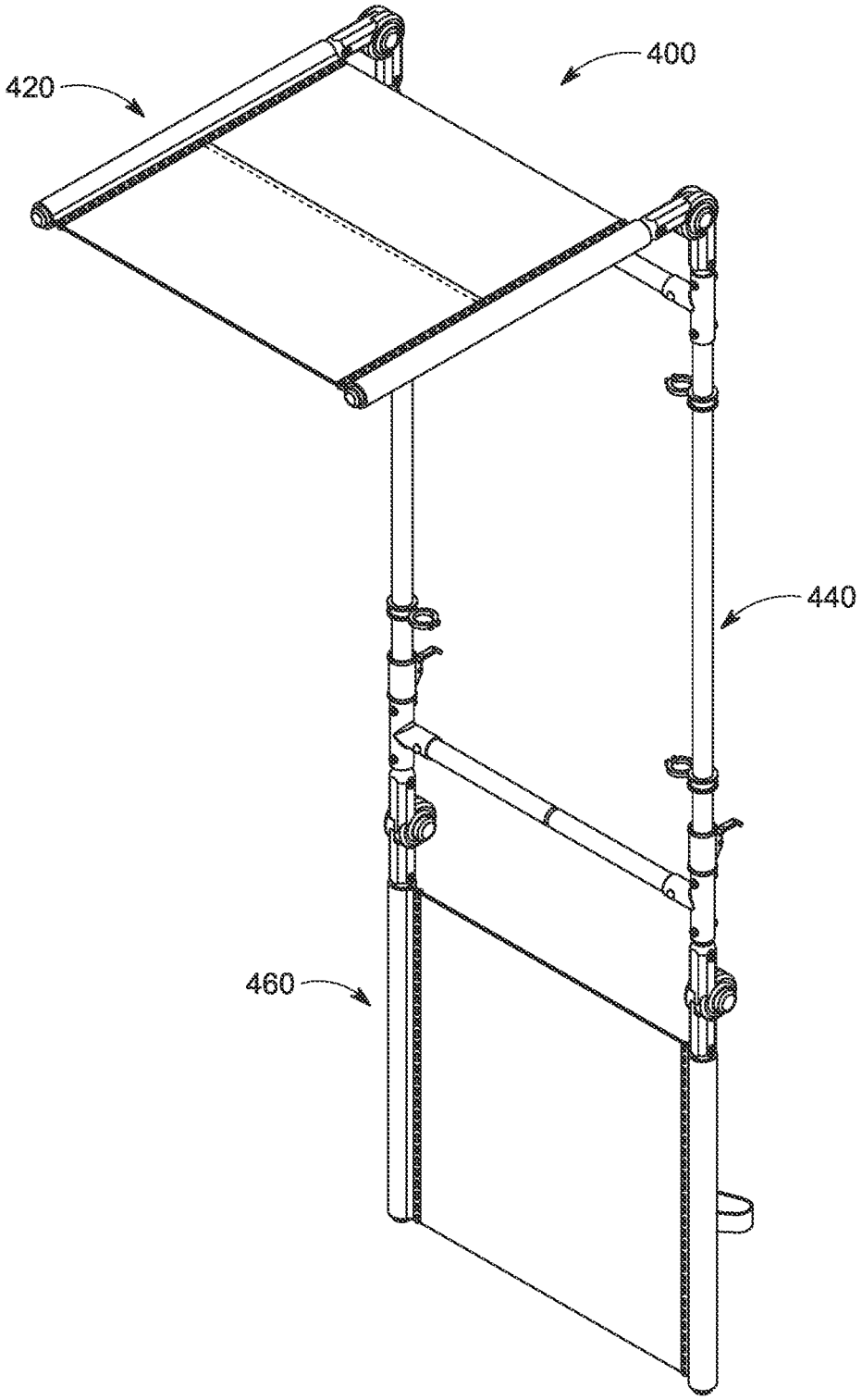
FIG. 15 is a front perspective view of the portable sunshade shown in FIG. 14.
Figure 16:
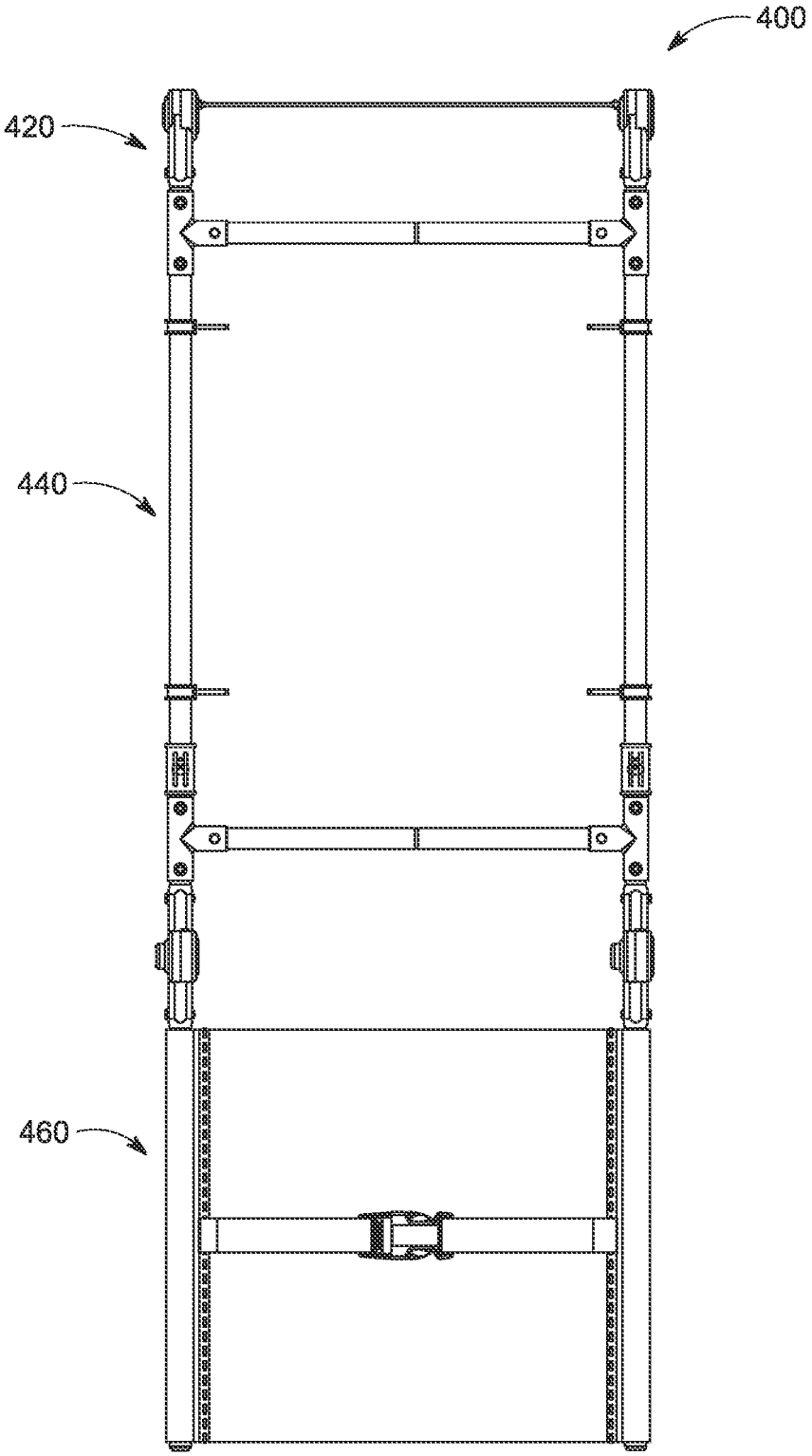
FIG. 16 is a rear elevational view of the portable sunshade shown in FIG. 15.
Figure 17:
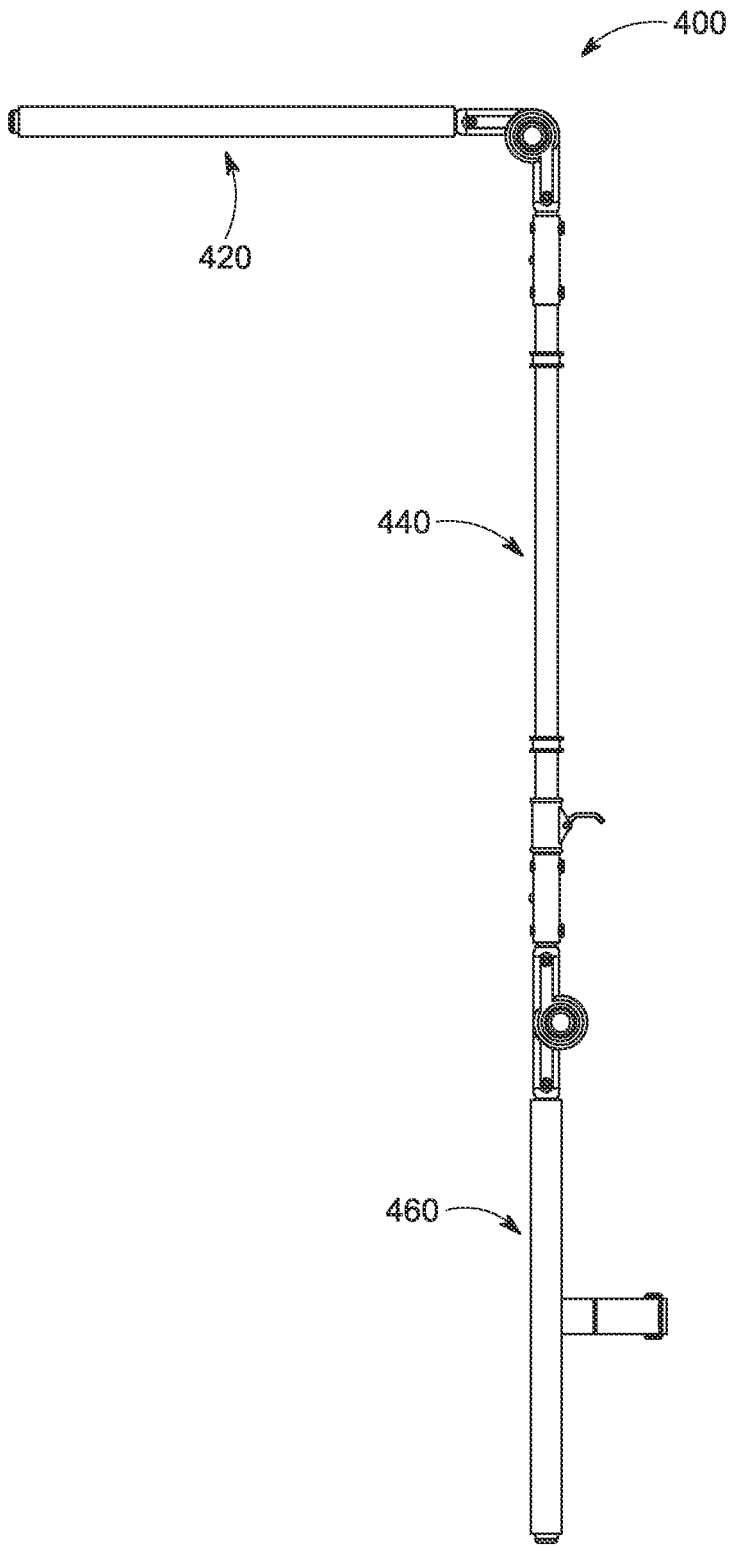
FIG. 17 is a right side elevational view of the portable sunshade shown in FIG. 15.
Figure 18:
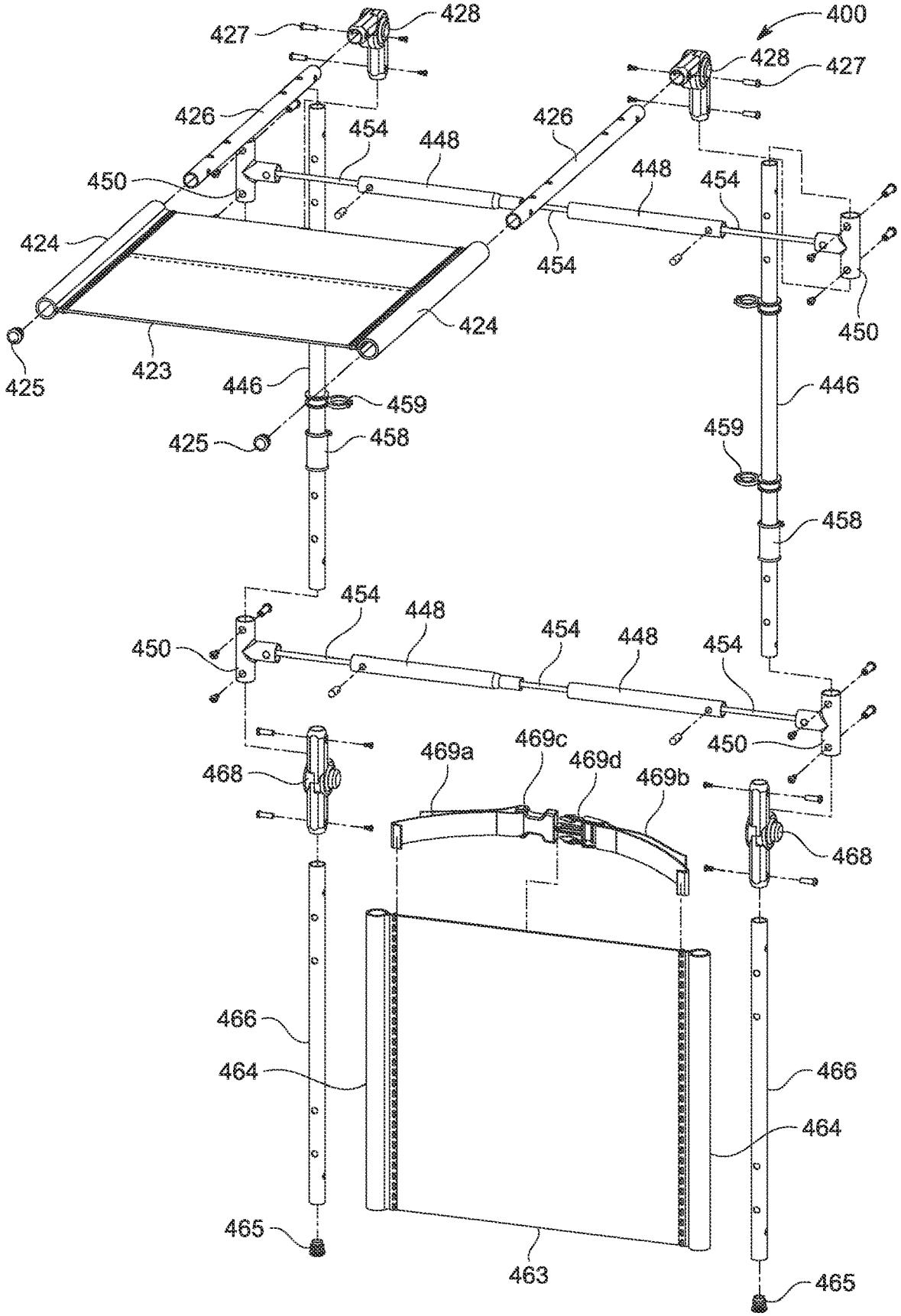
FIG. 18 is an exploded view of the portable sunshade shown in FIG. 15.

Portable sunshade 400 has a compact and light-weight construction configured for mounting to a backrest 310 of chair 300 as shown in FIG. 14. Bottom section 460 and a lower portion of center section 440 are configured to be attached to and rest against backrest 310 of chair 300 as shown in FIG. 14. Portable sunshade 400 is configured to be mounted and used in connection with any type of chair including a back rest, such as a beach chair.

FIGS. 15-18 show a front perspective view (FIG. 15), a rear elevational view (FIG. 16), a right side elevational view (FIG. 17), and an exploded view (FIG. 18) of portable sunshade 400 removed from chair 300 in FIG. 14. These figures illustrate the various parts of sections 420, 440 and 460 which can be readily assembled together to form portable sunshade 400.

Figure 19A:
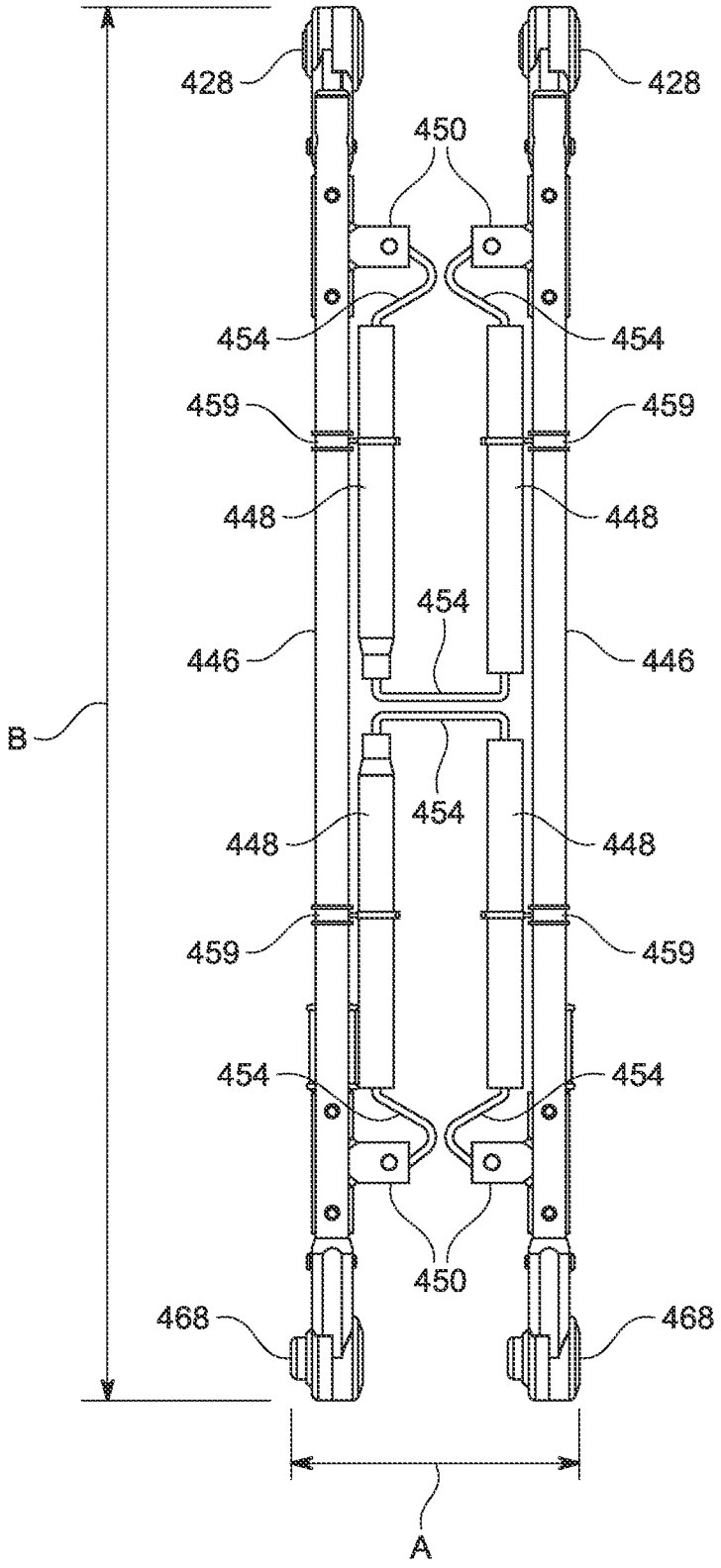
FIG. 19A is a front view of the portable sunshade of the second embodiment, without the fabric panels, shown in a completely folded or closed configuration.
Figure 19B:
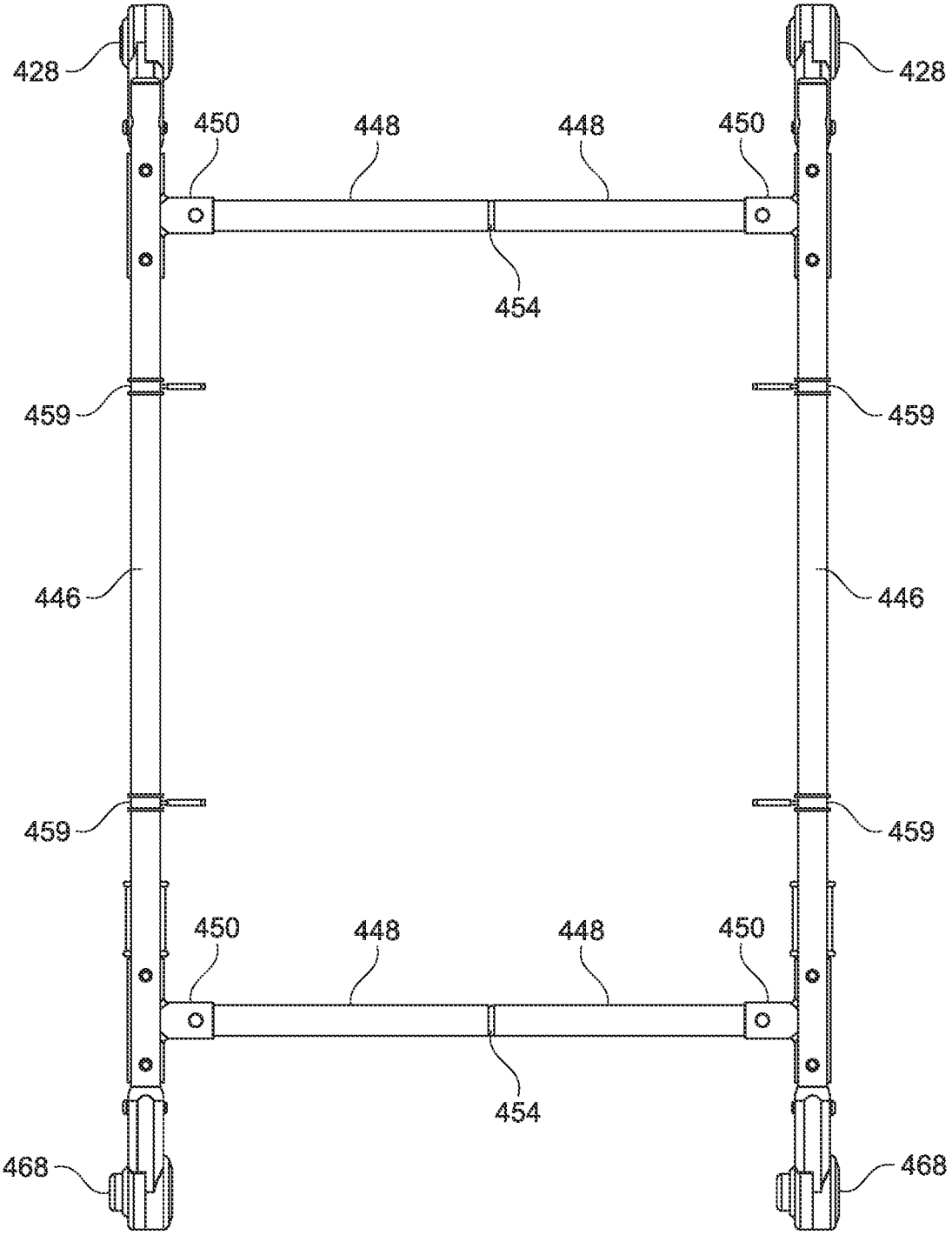
FIG. 19B is a front view of the portable sunshade of the second embodiment in a state of being folded or closed with frame tubes of a top section of the portable sunshade being lowered over a center section of the portable sunshade.
Figure 19C:
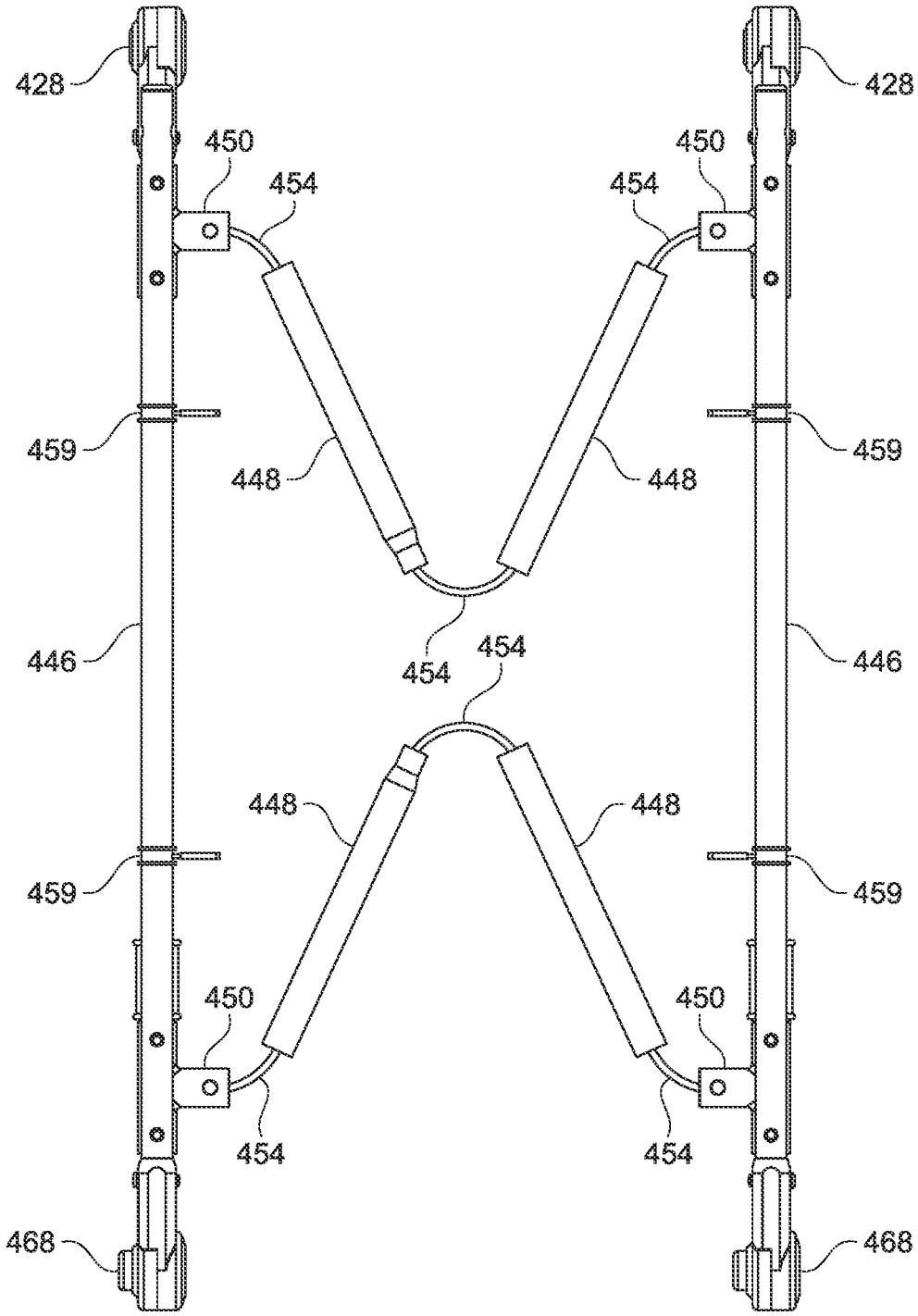
FIG. 19C is a front view of the portable sunshade of the second embodiment, without the fabric panels, shown in a partially folded or closed configuration.
Figure 20:
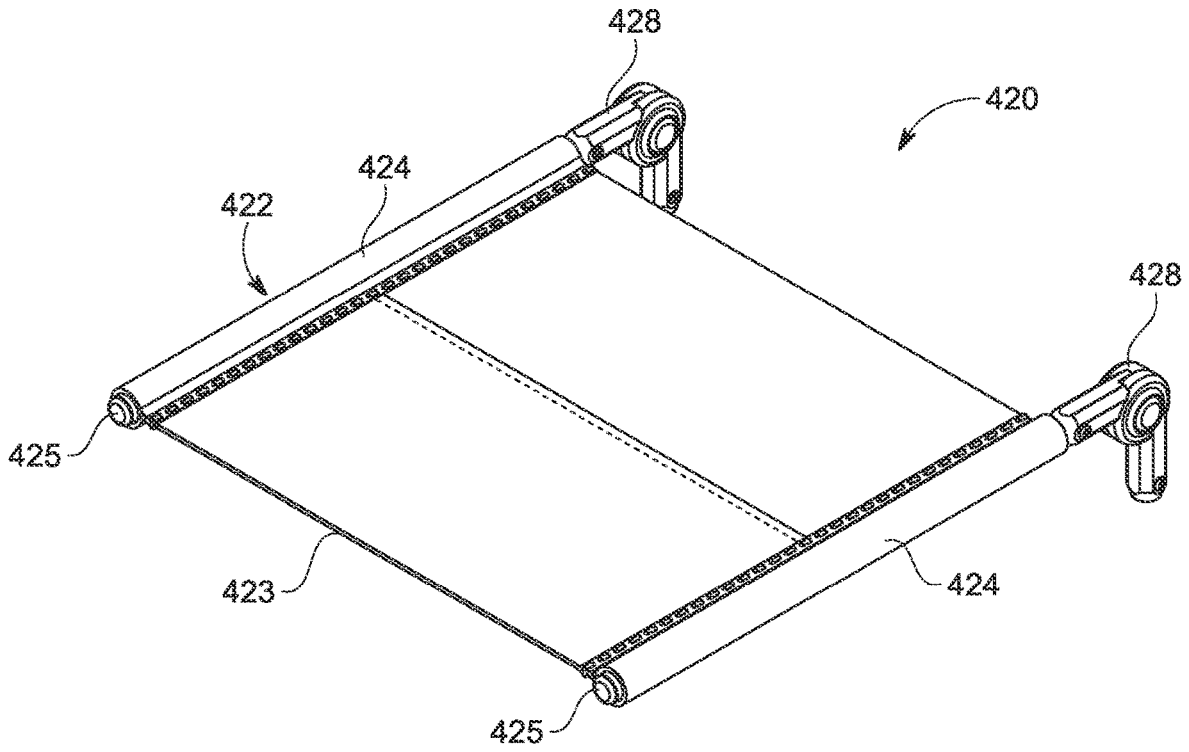
FIG. 20 is a perspective view of the top section of the portable sunshade of the second embodiment.
Figure 21:
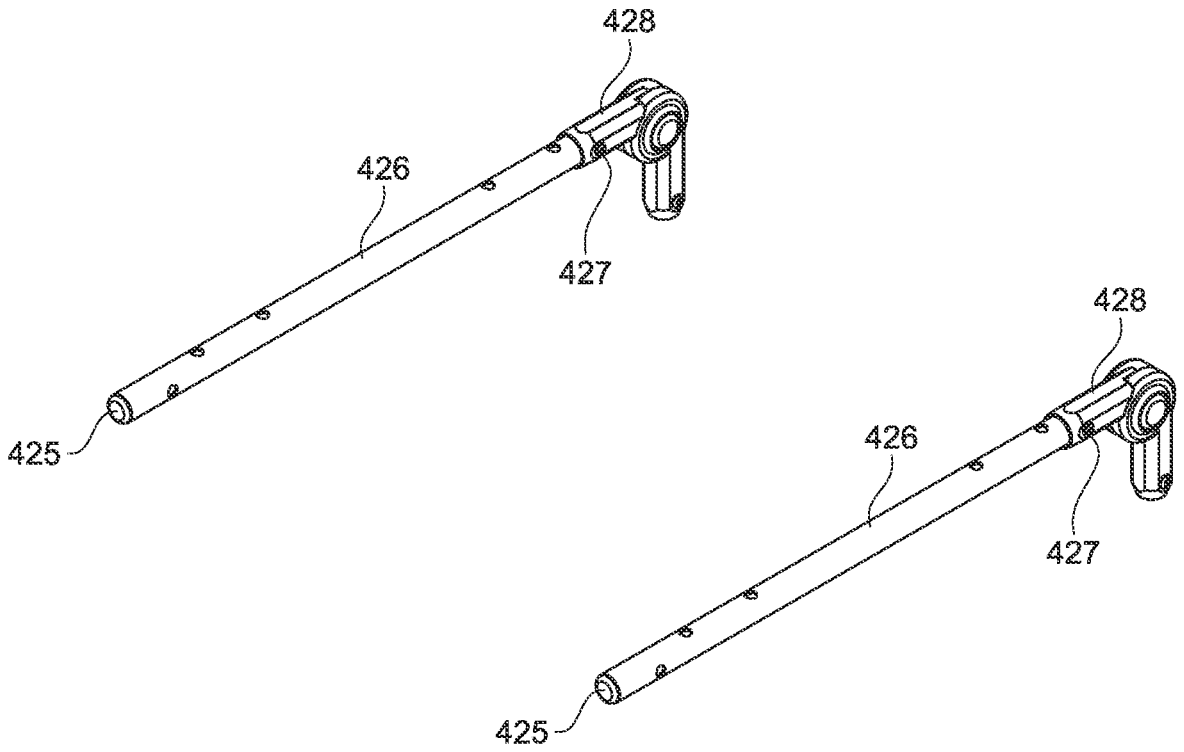
FIG. 21 show perspective views of top frame portions of the top section shown in FIG. 20.
Figure 22:
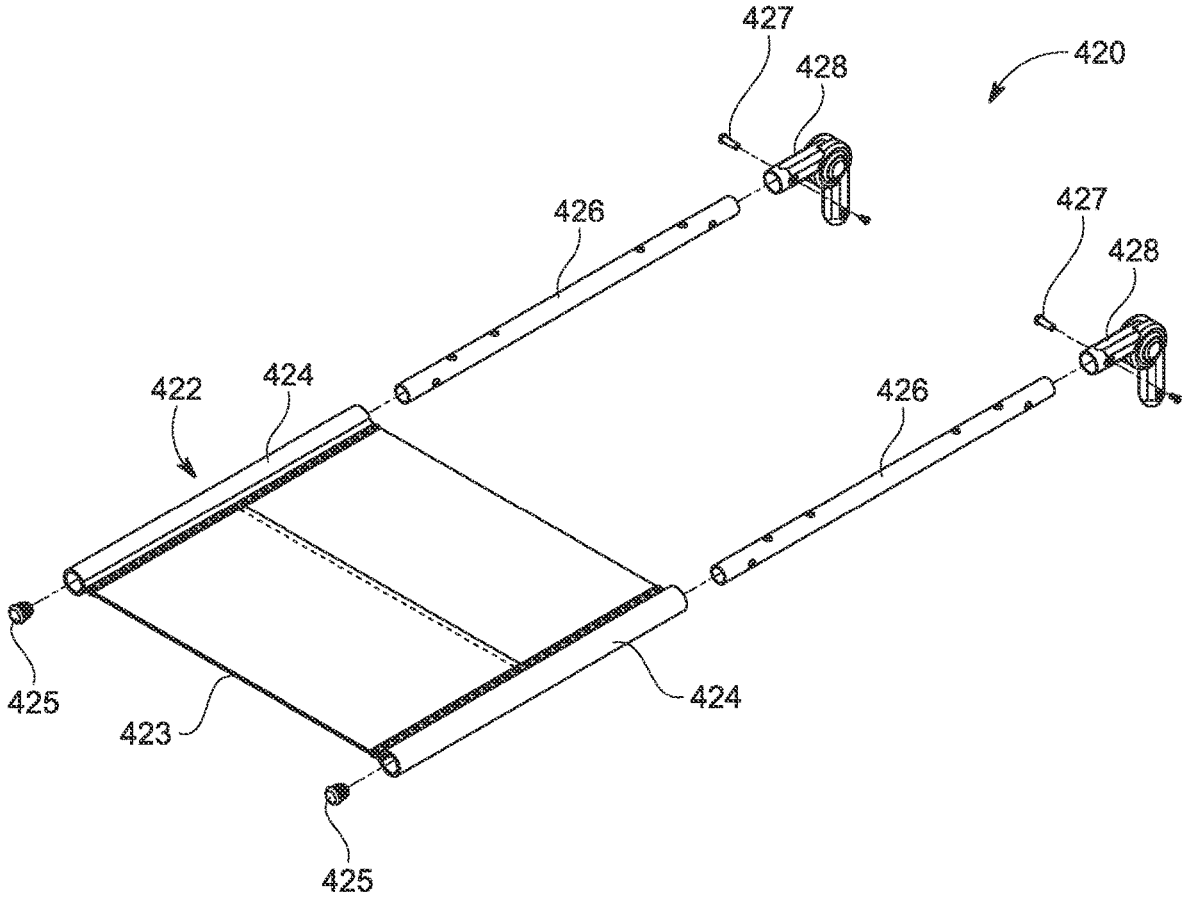
FIG. 22 is an exploded view of the top section shown in FIG. 20.

Referring to FIGS. 20-22, top section 420 includes a sunshade member 422, a pair of frame tubes (arms) 426, and a pair of adjustable hinge mechanisms 428. Sunshade member 422 includes a sunscreen fabric panel (canopy material) 423 that is mated to frame tubes 426 by way of fabric loops 424 formed on opposite edges of fabric panel 423. End caps 425 are fitted to respective outward facing open ends of frame tubes 426 as shown in FIGS. 20-21. In exemplary embodiments, end caps 425 can be dimensioned to restrict removal of fabric panel 423 from frame tubes 426. End caps 425 can also provide a seal against sand and water at the open ends of frame tubes 426. Adjustable hinge mechanisms 428 are configured for connection to respective inward facing ends of frame tubes 426 using suitable fasteners 427 via corresponding holes in these components, as shown in FIGS. 20-21. Adjustable hinge mechanisms 428 permit top section 420 to be pivoted relative to center section 440, and particularly allows frame tubes 426 to be lowered over center section 440 during a folding or closing operation of portable sunshade 400, as further described below with reference to FIGS. 19A-19C.

Figure 23:
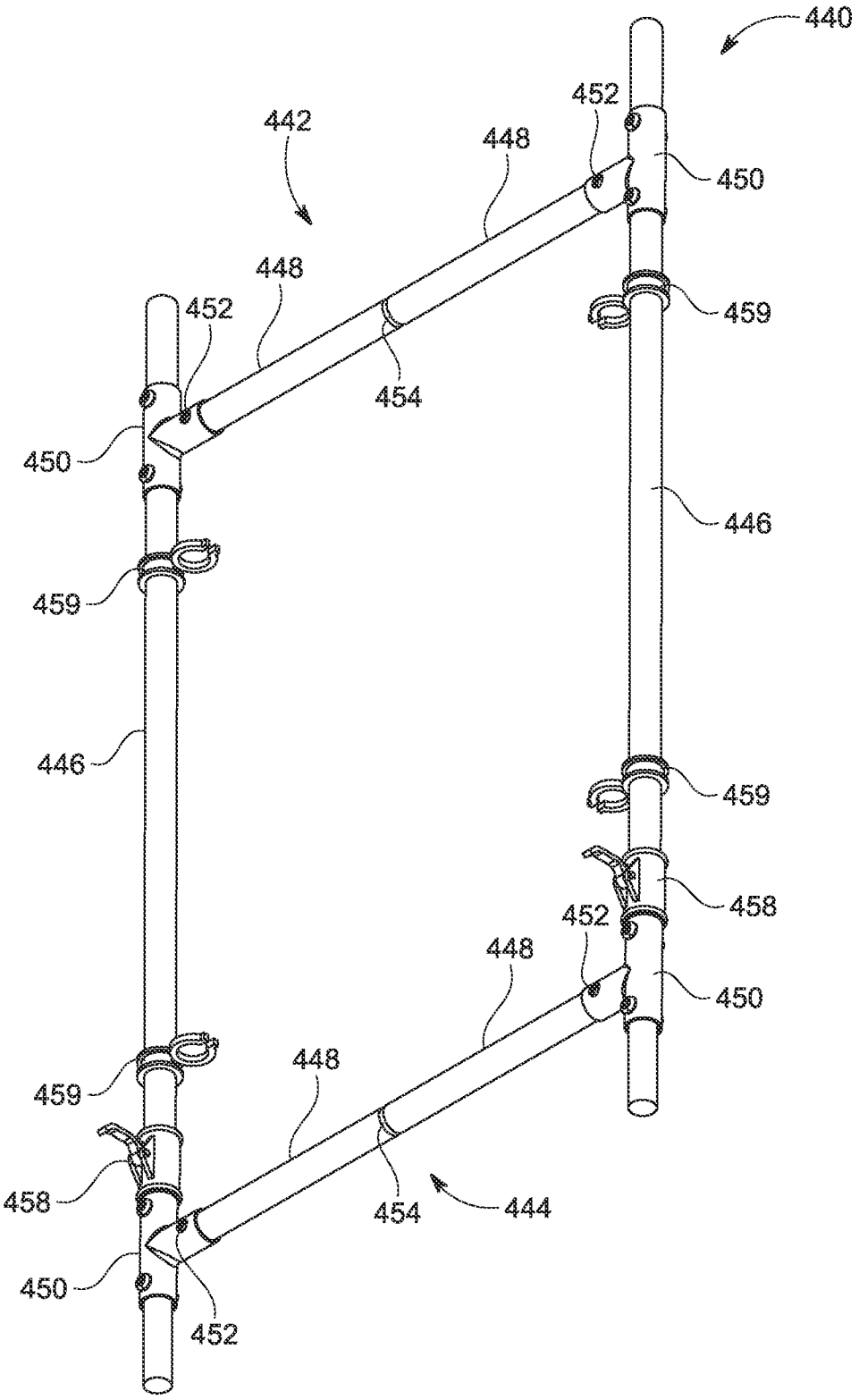
FIG. 23 is a perspective view of the center section of the portable sunshade of the second embodiment.
Figure 24:
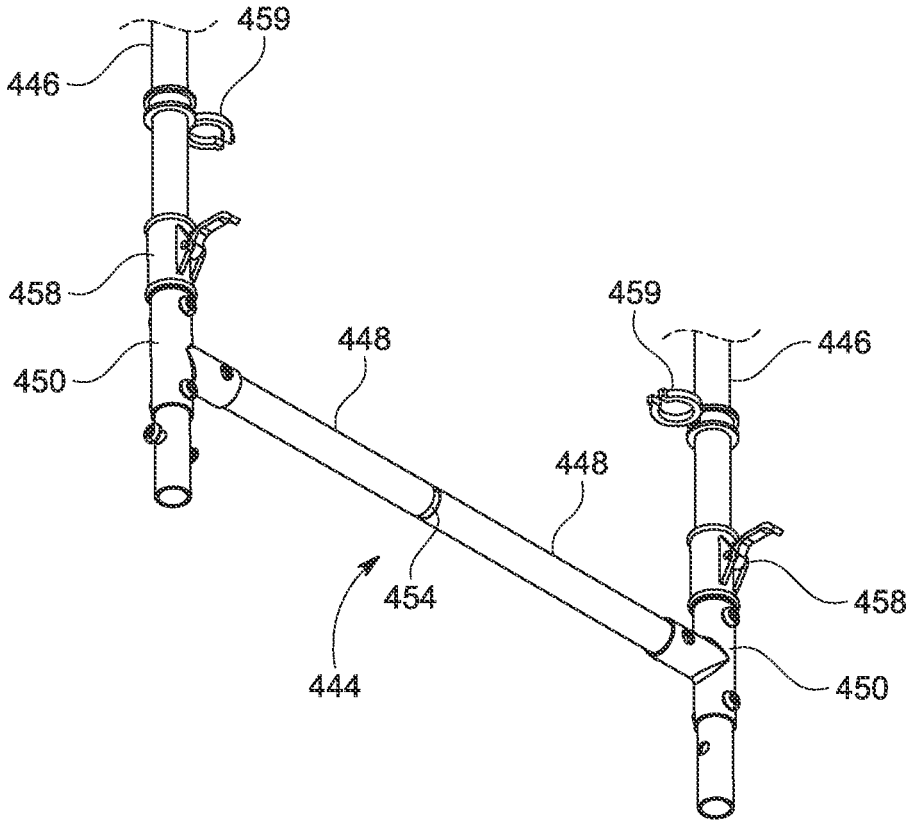
FIG. 24 is a perspective view of a lower portion of the center section shown in FIG. 23.
Figure 25:
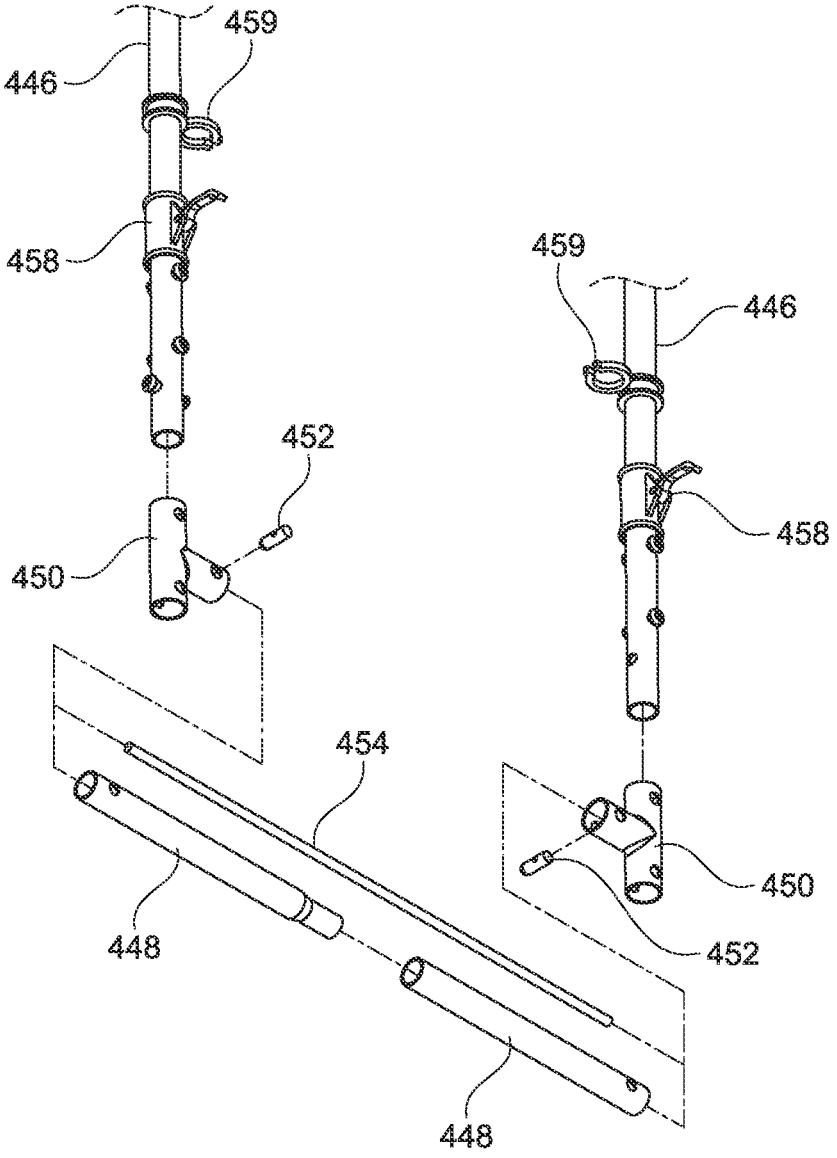
FIG. 25 is an exploded view of the lower portion shown in FIG. 24.

FIGS. 23-25 show center section 440 of portable sunshade 400. Center section 440 has opposite ends 442 (upper), 444 (lower) configured for removable connection to top section 420 and bottom section 460, respectively. Center section 440 includes a pair of frame tubes 446 extending generally parallel to one another in the assembled state of center section 440 shown in FIGS. 14-16 and 23, for example. At each of the upper 442 and lower 444 ends, frame tubes 446 are connected to cross tubes 448 by corresponding joints (e.g., T-joints) 450 using suitable removable fasteners 452 via corresponding holes in these components. FIG. 24 is a partial view of center section 440 illustrating the assembly of cross tubes 448 and joints 450 to frame tubes 446 at the lower end 444, and FIG. 25 is an exploded view of FIG. 24.

In the assembled state of center section 440, pairs of cross tubes 448 at each of the upper end 442 and lower end 444 are assembled in a generally linear relationship relative one another, and cross tubes 448 at the upper end 442 are disposed generally parallel to cross tubes 448 at the lower end 444. As shown in FIG. 25, an elastic cord element 454 is configured to extend through each pair of linearly assembled pair of cross tubes 448 at each of the upper 442 and lower 444 ends of center section 440. Each elastic cord element 454 is configured to be secured to corresponding joints 450 at upper 442 and lower 444 ends using suitable removable fasteners. Elastic cord elements 454 are configured to permit folding of portable sunshade 400 into a compact, closed configuration as shown in FIGS. 19A, 19C. In an exemplary embodiment, bungee cord can be used as the elastic cord elements 454.

A brace element 458 is mounted to each frame tube 446 near lower end 444 of center section 440. When portable sunshade 400 is used with chair 300 as shown in FIG. 14, for example, brace elements 458 are used to secure portable sunshade 400 to a portion 312 of chair backrest 310. Center section 440 is also provided with clamp connectors 459 for securing cross tubes 448 to frame tubes 446 in the folded or closed state of portable sunshade 400 as shown in FIG. 19A.

Figure 26:
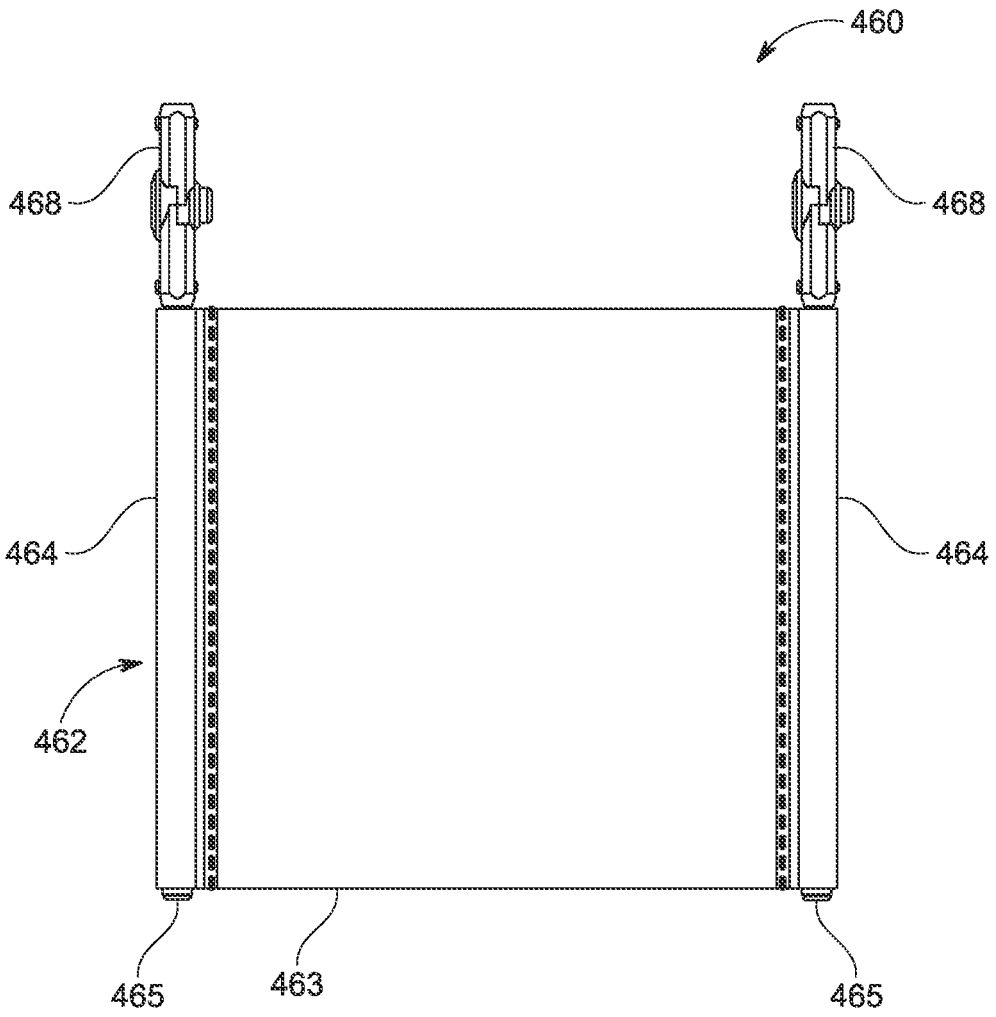
FIG. 26 is a front view of the bottom section of the portable sunshade of the second embodiment.
Figure 27:
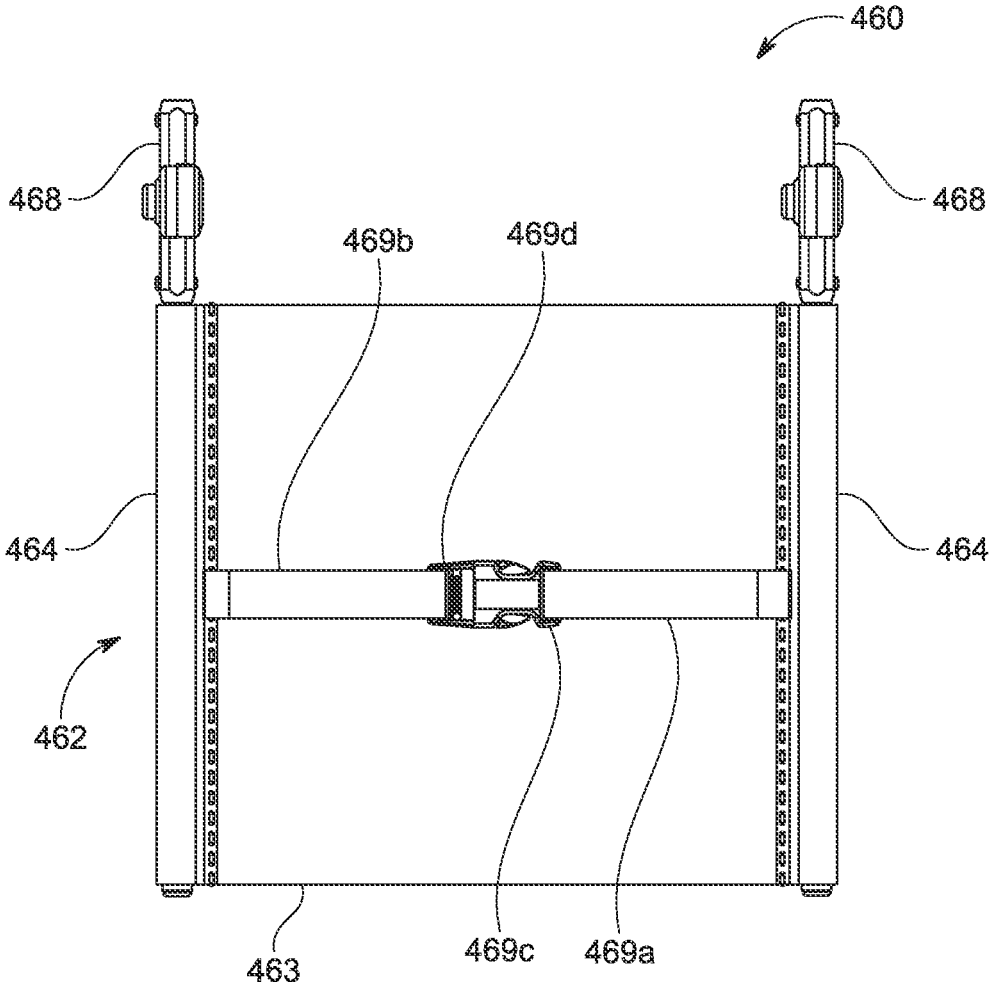
FIG. 27 is a rear view of the bottom section shown in FIG. 26.
Figure 28:
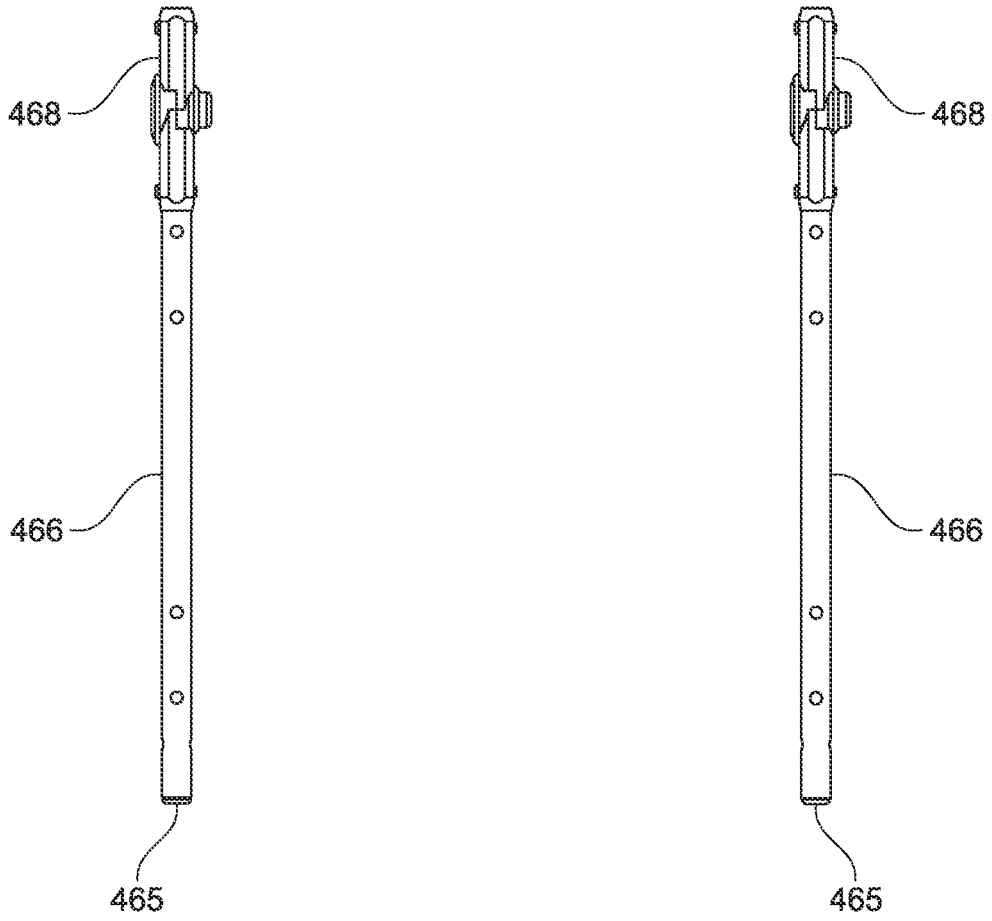
FIG. 28 show elevational views of frame portions of the bottom section in FIG. 26.
Figure 29:
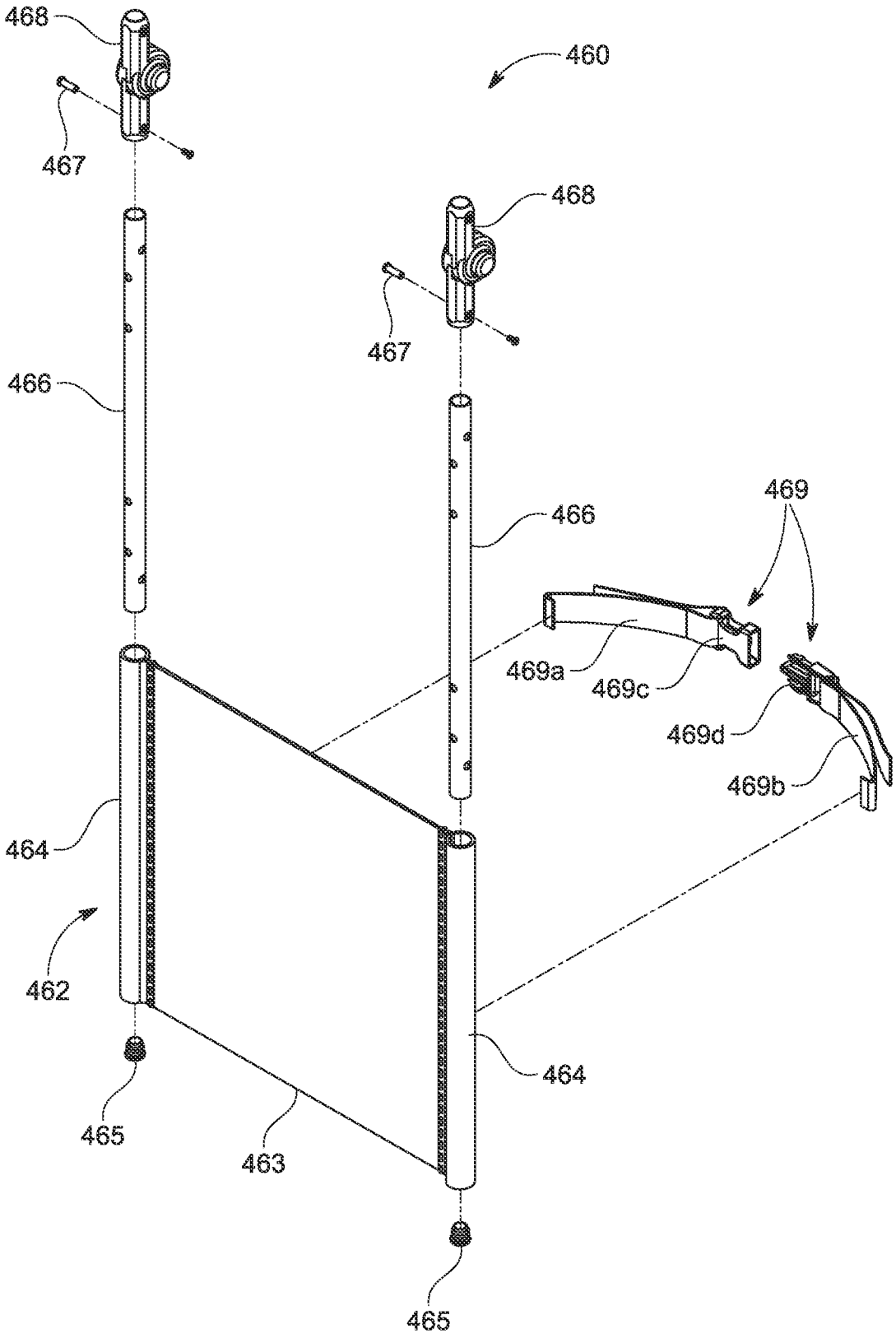
FIG. 29 is an exploded view of the bottom section in FIG. 26.

FIGS. 26-29 show bottom section 460 of portable sunshade 400. FIGS. 26 and 27 are front and rear views, respectively, of bottom section 460, FIG. 28 is a view similar to FIG. 26 but omitting the backrest member as further described below, and FIG. 29 is an exploded view of bottom section 460.

Bottom section 460 includes a backrest member 462, a pair of frame tubes (arms) 466, a pair of adjustable hinge mechanisms 468, and a connecting assembly 469. Backrest member 462 includes a fabric panel 463 that is mated to frame tubes 466 by way of fabric loops 464 formed on opposite edges of fabric panel 463. End caps 465 are fitted to respective outward facing open ends of frame tubes 466 as shown in the figures. In exemplary embodiments, end caps 426 can be dimensioned to restrict removal of fabric panel 463 from frame tubes 466. End caps 465 can also provide a seal against sand and water at the open ends of frame tubes 466.

Adjustable hinge mechanisms 468 are configured for connection to respective inward facing ends of frame tubes 466 using suitable removable fasteners 467 via corresponding holes in these components. Adjustable hinge mechanisms 468 permit frame tubes 426, and corresponding sunshade member 462, to be pivoted relative center section 440. Adjustable hinge mechanisms 468 have the same construction as adjustable hinge mechanisms 428 of top section 420.

As shown in FIG. 27, connecting assembly 469 is connected to and loops around a rear side of backrest member 462. Connecting assembly 469 is configured to removably securely hold backrest member 462 against backrest 310 of chair 300 during use of portable sunshade 400, as shown in FIG. 14. In this embodiment, connecting assembly 469 includes band or strap members 469*a*, 469*b* secured (e.g., by sewing) at one end to fabric panel 463, and buckle members 469*c* (e.g., female buckle member) and 469*d* (e.g., male buckle member) connected to free ends of respective strap members 469*a*, 469*b* for releasable connection to one another as shown in FIG. 27. It is understood that other types of removable connection assemblies are suitable for portable sunshade 400 so long as it is configured to removably securely hold backrest member 462 against backrest 310 of chair 300 during use of portable sunshade 400.

FIGS. 19A-19C show various stages of folding/closing portable sunshade 400, with fabric panels 423 and 463 having been previously removed. FIG. 19B shows the state in which frame tubes 426 of top section 420 have been initially lowered by action of hinge mechanisms 428 over center section 440. From the configuration in FIG. 19B, FIG. 19C shows the state in which cross tubes 448 are initially collapsed by action of elastic cord elements 454. From the configuration in FIG. 19C, FIG. 19A shows the configuration of portable sunshade 400 in a completely folded/closed configuration. In the folded/closed configuration shown in FIG. 19A, clamp connectors 459 are clamped to respective cross tubes 448 to securely hold cross tubes 448 relative to frame tubes 446.

Fabric panel 423 of top section 420 can be manufactured from any commonly known textile, such as nylon, polyester, rayon, cotton, or a combination of materials. Desirably, fabric panel 423 can block light penetration therethrough. However, in some embodiments the fabric panel 423 is configured to block a portion of sunlight incident to fabric panel 423. In other embodiments, fabric panel 423 is selected for an ability to block certain wavelengths of sunlight, for example ultraviolet wavelengths, which are of most concern. Additionally, fabric panel 423 may be formed of two overlapping pieces of material that creates an air vent, minimizing the risk of the portable sunshade 400 flipping over in strong winds. Fabric panel 463 of bottom section 460 can be made from the same material as fabric panel 423. In other embodiments, the fabric panel 463 can be made from a material different than fabric panel 423.

Frame tubes 426, 446, 466, cross tubes 488, and joints 450 of top (410), center (440) and bottom (460) sections of portable sunshade 400 can be made of any suitable light-weight material exhibiting sufficient material strength for this purpose, such as various types of aluminum alloys. Other materials for these components of portable sunshade 400 include various available light-weight, tough and durable plastic materials.

It will be appreciated that portable sunshade 400 has a construction which is light-weight and compact so that it can be readily and securely mounted to a backrest of a chair, such as beach chair 300 as shown in FIG. 14. Hinge mechanisms 428, 468 of the top 420 and bottom 460 sections allow portable sunshade 400 to be easily folded and closed into a compact form factor for portability as shown in FIG. 19A. For example, hinge mechanisms 428, 468 can be in the form of ratchet hinges and similar types of devices. Alternatively, any means for enabling top section 420 and bottom section 460 to be pivoted relative to center section 440 is suitable without departing from the scope of the invention.

In the folded/closed configuration shown in FIG. 19A, portable sunshade 400 can be easily transported and/or stored. In an exemplary embodiment, in the folded/closed configuration portable sunshade 400 has an overall width "A" in the range of about 2 inches to about 6 inches and an overall height "B" in the range of about 12 inches to 24 inches. In a preferred embodiment, the dimension "A" is about 3.5 inches and the dimension "B" is about 16 inches.

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment. However, it is to be appreciated that features of one or more embodiments can be combined given the teachings of the present invention provided herein.

The foregoing is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the present invention and that those skilled in the art may implement various modifications without departing from the scope and spirit of the invention. Those skilled in the art could implement various other feature combinations without departing from the scope and spirit of the invention. Having thus described aspects of the invention, with the details and particularity required by the patent laws, what is claimed and desired protected by Letters Patent is set forth in the appended claims.

What is claimed is:

1. A portable sunshade, comprising:

a backrest member configured to contact a backrest of a chair;

a chair holding member coupled to an upper end of the backrest member;

a sunshade member configured, when deployed, to extend horizontally with respect to the backrest member;

a connecting member including opposing rails having crossbars spanning therebetween at an upper end and a lower end of the opposing rails, the opposing rails being rotationally affixed to the sunshade member at the upper end and rotationally affixed to the backrest member at the lower end; and means collapsing each of the crossbars to allow folding of the portable sunshade into a compact form factor;

wherein the chair holding member includes an upper arm joined to the lower end of the connecting member, and a lower arm joined to the backrest member; and wherein the chair holding member includes a chair receiving notch formed between the upper arm and the lower arm, the chair receiving notch being configured to accept a top rail of the chair.

2. The portable sunshade as in claim 1, wherein the sunshade member includes a sunshade fabric spanning between two horizontally disposed rails.

3. The portable sunshade as in claim 1, wherein the backrest member includes a backrest fabric spanning between two vertically disposed rails.

4. The portable sunshade as in claim 1, wherein the means for collapsing allows the portable sunshade to be folded into a compact form by folding the sunshade member from a position perpendicular to the connecting member to a position parallel with and overlapping the connecting member.

5. A portable sunshade, comprising:

a backrest member configured to contact a backrest of a chair;

a chair holding member coupled to an upper end of the backrest member;

a sunshade member configured, when deployed, to extend horizontally with respect to the backrest member;

a connecting member including opposing rails having crossbars spanning therebetween at an upper end and a lower end of the opposing rails, the opposing rails being rotationally affixed to the sunshade member at the upper end and rotationally affixed to the backrest member at the lower end: and means collapsing each of the crossbars to allow folding of the portable sunshade into a compact form factor, wherein the means for collapsing each of the crossbars comprises an elastic cord element.

6. The portable sunshade as in claim 5, wherein the means for collapsing further includes means for collapsing each of the crossbars at a midpoint of each crossbar.

7. The portable sunshade of claim 5, wherein the elastic cord element comprises a bungee cord.

8. A method comprising: providing a portable sunshade having a horizontally extending sunshade member, a backrest member and a connecting member including opposing rails having crossbars spanning therebetween;

folding the sunshade member from a position perpendicular to the connecting member to a position parallel with and overlapping the connecting member;

folding the backrest member to overlap the connecting member on a side opposite the sunshade member; and collapsing each of the crossbars to allow folding of the portable sunshade into a compact form factor, wherein the collapsing of each of the crossbars is done by action of an elastic cord element.

9. The portable sunshade of claim 8, wherein the elastic cord element comprises a bungee cord.

10. A portable sunshade, comprising:

a first pair of rail members for supporting a first panel configured for providing sunshade during use of the portable sunshade;

a first cross member configured to interconnect the first pair of rail members in spaced apart relation thereto, the first pair of rail members being configured for removable connection to opposite end portions of the first cross member and for selective rotational movement relative to the cross member;

a second pair of rail members having first end portions configured for removable connection to respective opposite end portions of the first cross member;

a second cross member having opposite end portions configured for connection to second end portions of the second pair of rails members;

a third pair of rail members configured for mounting the portable sunshade to a movable or fixed structure, each of the third pair of rail members having an end portion configured for removable connection to respective opposite end portions of the second cross member; and means for collapsing each of the cross members to allow folding of the portable sunshade into a compact form factor.

11. The portable sunshade as in claim 10, wherein the first panel comprises a sunshade fabric spanning between the first pair of rail members.

12. The portable sunshade as in claim 10, wherein the third pair of rail members are configured for supporting a second panel defining a backrest for an individual using the portable sunshade.

13. The portable sunshade as in claim 10, wherein the means for collapsing allows the portable sunshade to be folded into a compact form by folding the first pair of rail members from a position perpendicular to the second pair of rail members to a position parallel with and overlapping the second pair of rail members.

14. The portable sunshade as in claim 10, wherein the means for collapsing each of the cross members comprises an elastic cord element.

15. The portable sunshade of claim 14, wherein the elastic cord element comprises a bungee cord.

16. The portable sunshade as in claim 10, wherein the means for collapsing includes means for collapsing each of the cross members at a midpoint of each cross member.

* * * * *